US006355869B1

(12) United States Patent
Mitton

(10) Patent No.: US 6,355,869 B1
(45) Date of Patent: Mar. 12, 2002

(54) METHOD AND SYSTEM FOR CREATING MUSICAL SCORES FROM MUSICAL RECORDINGS

(76) Inventor: Duane Mitton, 844 Hollow Rd., Marion, VA (US) 24354

( * ) Notice: Subject to any disclaimer, the term of this patent is extended or adjusted under 35 U.S.C. 154(b) by 0 days.

(21) Appl. No.: 09/643,132

(22) Filed: Aug. 21, 2000

Related U.S. Application Data

(60) Provisional application No. 60/149,790, filed on Aug. 19, 1999.

(51) Int. Cl.[7] ..... G10H 7/00
(52) U.S. Cl. ..... 84/603; 84/616; 84/645
(58) Field of Search ..... 84/603, 605, 645, 84/609, 616, 654

(56) References Cited

U.S. PATENT DOCUMENTS 4,377,961 A * 3/1983 Bode
4,960,031 A 10/1990 Farrand ..... 84/609
5,054,360 A 10/1991 Lisle et al. ..... 84/645
5,440,756 A * 8/1995 Larson
5,831,193 A * 11/1998 Suzuki et al. ..... 84/603
5,986,199 A * 11/1999 Peevers ..... 84/603
6,121,530 A * 9/2000 Sonoda
6,140,568 A * 10/2000 Kohler

* cited by examiner

*Primary Examiner*—Jeffrey Donels
(74) *Attorney, Agent, or Firm*—Christie, Parker & Hale, LLP

(57) ABSTRACT

A method and a system for obtaining a musical score from a musical recording is disclosed. The present invention further provides a method and system for creating an editable music file from a musical recording, such that a user may modify the musical recording and obtain a musical score from the modified musical recording. The method comprises operations of: (1) storing a musical recording as a wave file; (2) generating a pseudo wave file for each segment of interest from the wave file; (3) generating a sequence file for each of the pseudo wave files; (4) generating a list of events from the sequence files; (5) converting the list of events from the sequence file into a MIDI or other notation readable program file; and (6) importing the MIDI or other file into the notation program in order to print the musical score.

19 Claims, 33 Drawing Sheets

FIG. 2

| MN | K | O | P(Hz) |
|---|---|---|---|
| 36 | C | 3 | 65.4064 |
| 37 | C# | 3 | 69.2957 |
| 38 | D | 3 | 73.4162 |
| 39 | D# | 3 | 77.7818 |
| 40 | E | 3 | 82.4069 |
| 41 | F | 3 | 87.3071 |
| 42 | F# | 3 | 92.4986 |
| 43 | G | 3 | 97.9989 |
| 44 | G# | 3 | 103.826 |
| 45 | A | 3 | 110.000 |
| 46 | A# | 3 | 116.541 |
| 47 | B | 3 | 123.471 |
| 48 | C | 4 | 130.813 |
| 49 | C# | 4 | 138.591 |
| 50 | D | 4 | 146.832 |
| 51 | D# | 4 | 155.564 |
| 52 | E | 4 | 164.814 |
| 53 | F | 4 | 174.614 |
| 54 | F# | 4 | 184.997 |
| 55 | G | 4 | 195.998 |
| 56 | G# | 4 | 207.652 |
| 57 | A | 4 | 220.000 |
| 58 | A# | 4 | 233.082 |
| 59 | B | 4 | 246.942 |
| 60 | C | 5 | 261.626 |
| 61 | C# | 5 | 277.183 |
| 62 | D | 5 | 293.665 |
| 63 | D# | 5 | 311.127 |
| 64 | E | 5 | 329.628 |
| 65 | F | 5 | 349.228 |
| 66 | F# | 5 | 369.994 |

| MN | K | O | P(Hz) |
|---|---|---|---|
| 66 | F# | 5 | 369.994 |
| 67 | G | 5 | 391.995 |
| 68 | G# | 5 | 415.305 |
| 69 | A | 5 | 440.000 |
| 70 | A# | 5 | 466.164 |
| 71 | B | 5 | 493.883 |
| 72 | C | 6 | 523.251 |
| 73 | C# | 6 | 554.365 |
| 74 | D | 6 | 587.330 |
| 75 | D# | 6 | 622.254 |
| 76 | E | 6 | 659.255 |
| 77 | F | 6 | 698.456 |
| 78 | F# | 6 | 739.989 |
| 79 | G | 6 | 783.991 |
| 80 | G# | 6 | 830.609 |
| 81 | A | 6 | 880.000 |
| 82 | A# | 6 | 932.328 |
| 83 | B | 6 | 987.767 |
| 84 | C | 7 | 1046.50 |
| 85 | C# | 7 | 1108.73 |
| 86 | D | 7 | 1174.66 |
| 87 | D# | 7 | 1244.51 |
| 88 | E | 7 | 1318.51 |
| 89 | F | 7 | 1396.91 |
| 90 | F# | 7 | 1479.98 |
| 91 | G | 7 | 1567.98 |
| 92 | G# | 7 | 1661.22 |
| 93 | A | 7 | 1760.00 |
| 94 | A# | 7 | 1864.66 |
| 95 | B | 7 | 1975.53 |
| 96 | C | 8 | 2093.00 |

FIG. 3

```
DATA "C ", "C# ", "D ", "D# ", "E "
DATA "F ", "F# ", "G ", "G# ", "A "
DATA "A ", "B# ", "C "
DIM k$(0 TO 12)
FOR i = 0 TO 12: READ k$(i): NEXT i
C0 = 440 * 2 ^ (-69 / 12)
'NOTE C0 = 8.1758 Hz
FOR j = 0 TO 1
   PRINT "  MN K  O P(Hz)  ";
NEXT j: PRINT
FOR i = 36 TO 66
   PRINT "  ";
   FOR j = 0 TO 1
     M = i + 30 * j
     O = M \ 12
     N = M MOD 12
     P = C0 * 2 ^ (M / 12)
     PRINT USING "## "; M;
     PRINT k$(N);
     PRINT USING "# "; O;
     SELECT CASE P
     CASE IS > 999
        PRINT USING "####.## "; P;
     CASE IS > 99
        PRINT USING "###.### "; P;
     CASE ELSE
        PRINT USING "##.#### "; P;
     END SELECT
     IF j = 0 THEN
        PRINT "    ";
     ELSE
        PRINT
     END IF
   NEXT j
NEXT i
```

FIG. 4

| | | | | | |
|---|---|---|---|---|---|
| C | 1046.50 | / | 1046.50 | = | 1.000 |
| C# | 1108.73 | / | 1046.50 | = | 1.059 |
| D | 1174.66 | / | 1046.50 | = | 1.122 |
| D# | 1244.51 | / | 1046.50 | = | 1.189 |
| E | 1318.51 | / | 1046.50 | = | 1.260 |
| F | 1396.91 | / | 1046.50 | = | 1.335 |
| F# | 1479.98 | / | 1046.50 | = | 1.414 |
| G | 1567.98 | / | 1046.50 | = | 1.498 |
| G# | 1661.22 | / | 1046.50 | = | 1.587 |
| A | 1760.00 | / | 1046.50 | = | 1.682 |
| A# | 1864.66 | / | 1046.50 | = | 1.782 |
| B | 1975.53 | / | 1046.50 | = | 1.888 |
| C | 2093.00 | / | 1046.50 | = | 2.000 |

FIG. 7

STRAIGHT LINE APPROXIMATION

| K | COEF. | | I | | Fa | Fr | Cts |
|---|---|---|---|---|---|---|---|
| C | 0.08012 | * | 12 | = | 0.9614 | 1.0000 | −46 |
| C# | 0.08012 | * | 13 | = | 1.0416 | 1.0595 | −21 |
| D | 0.08012 | * | 14 | = | 1.1217 | 1.1225 | −1 |
| D# | 0.08012 | * | 15 | = | 1.2018 | 1.1892 | +15 |
| E | 0.08012 | * | 16 | = | 1.2819 | 1.2599 | +26 |
| F | 0.08012 | * | 17 | = | 1.3620 | 1.3348 | +33 |
| F# | 0.08012 | * | 18 | = | 1.4422 | 1.4142 | +34 |
| G | 0.08012 | * | 19 | = | 1.5223 | 1.4983 | +29 |
| G# | 0.08012 | * | 20 | = | 1.6024 | 1.5874 | +18 |
| A | 0.08012 | * | 21 | = | 1.6825 | 1.6818 | +1 |
| A# | 0.08012 | * | 22 | = | 1.7626 | 1.7818 | −23 |
| B | 0.08012 | * | 23 | = | 1.8428 | 1.8877 | −54 |
| C | 0.08012 | * | 24 | = | 1.9229 | 2.000 | −93 |

FIG. 9

TWO-SEGMENT APPROXIMATION

| K | COEF | | I | | Fa | Fr | Cts |
|---|---|---|---|---|---|---|---|
| C | 0.06634 | * | 15 | = | 0.9951 | 1.0000 | −9 |
| C# | 0.06634 | * | 16 | = | 1.0614 | 1.0595 | −3 |
| D | 0.06634 | * | 17 | = | 1.1278 | 1.1225 | −8 |
| D# | 0.06634 | * | 18 | = | 1.1941 | 1.1892 | +7 |
| E | 0.06634 | * | 19 | = | 1.2605 | 1.2599 | +1 |
| F | 0.06634 | * | 20 | = | 1.3268 | 1.3348 | −10 |
| F# | 0.09382 | * | 15 | = | 1.4073 | 1.4142 | −8 |
| G | 0.09382 | * | 16 | = | 1.5011 | 1.4983 | +3 |
| G# | 0.09382 | * | 17 | = | 1.5949 | 1.5874 | +8 |
| A | 0.09382 | * | 18 | = | 1.6888 | 1.6818 | +7 |
| A# | 0.09382 | * | 19 | = | 1.7826 | 1.7818 | +1 |
| B | 0.09382 | * | 20 | = | 1.8764 | 1.8877 | −10 |
| C | 0.09382 | * | 21 | = | 1.9702 | 2.000 | −26 |

FIG. 11

THREE-SEGMENT APPROXIMATION

| K | COEF. | | I | | Fa | Fr | Cts |
|---|---|---|---|---|---|---|---|
| C | 0.06244 | * | 16 | = | 0.9990 | 1.0000 | −2 |
| C# | 0.06244 | * | 17 | = | 1.0615 | 1.0595 | +3 |
| D | 0.06244 | * | 18 | = | 1.1239 | 1.1225 | +2 |
| D# | 0.06244 | * | 19 | = | 1.1864 | 1.1892 | −4 |
| E | 0.07867 | * | 16 | = | 1.2587 | 1.2599 | −2 |
| F | 0.07867 | * | 17 | = | 1.3374 | 1.3348 | +3 |
| F# | 0.07867 | * | 18 | = | 1.4161 | 1.4142 | +2 |
| G | 0.07867 | * | 19 | = | 1.4947 | 1.4983 | −4 |
| G# | 0.09912 | * | 16 | = | 1.5859 | 1.5874 | −2 |
| A | 0.09912 | * | 17 | = | 1.6850 | 1.6818 | +3 |
| A# | 0.09912 | * | 18 | = | 1.7842 | 1.7818 | +2 |
| B | 0.09912 | * | 19 | = | 1.8833 | 1.8877 | −4 |
| C | 0.09912 | * | 20 | = | 1.9824 | 2.000 | −15 |

FIG. 13

| Fi | REAL | Imag | Abs | Si |
|---|---|---|---|---|
| 14.0 | −0.000 | −0.000 | 0.000 | 0.000 |
| 14.2 | −3.860 | −1.861 | 4.286 | 4.277 |
| 14.4 | −6.602 | +1.649 | 6.805 | 7.452 |
| 14.6 | −4.364 | +6.353 | 7.707 | 8.073 |
| 14.8 | +0.047 | +5.703 | 5.703 | 5.443 |
| 15.0 | −0.000 | −0.000 | 0.000 | 0.000 |
| 15.2 | −6.046 | −2.822 | 6.673 | 6.652 |
| 15.4 | −11.185 | +2.613 | 11.486 | 12.109 |
| 15.6 | −8.241 | +10.624 | 13.445 | 13.839 |
| 15.8 | −0.429 | +10.202 | 10.211 | 9.979 |
| 16.0 | −0.000 | +0.000 | 0.000 | 0.000 |
| 16.2 | −13.658 | −6.200 | 14.999 | 14.968 |
| 16.4 | −30.951 | +6.806 | 31.691 | 32.291 |
| 16.6 | −31.409 | +36.321 | 48.018 | 48.437 |
| 16.8 | −5.646 | +59.810 | 60.076 | 59.871 |
| 17.0 | +32.000 | +55.426 | 64.000 | 64.000 |
| 17.2 | +54.697 | +24.244 | 59.829 | 59.871 |
| 17.4 | +47.988 | −9.982 | 49.015 | 48.437 |
| 17.6 | +22.592 | −23.684 | 32.732 | 32.291 |
| 17.8 | +2.176 | −14.629 | 14.790 | 14.968 |
| 18.0 | +0.000 | +0.000 | 0.000 | 0.000 |
| 18.2 | +9.104 | +3.955 | 9.926 | 9.979 |
| 18.4 | +14.122 | −2.793 | 14.396 | 13.839 |
| 18.6 | +9.072 | −8.698 | 12.568 | 12.109 |
| 18.8 | +1.305 | −6.369 | 6.502 | 6.652 |
| 19.0 | +0.000 | +0.000 | 0.000 | 0.000 |
| 19.2 | +4.947 | +2.115 | 5.380 | 5.443 |
| 19.4 | +8.459 | −1.597 | 8.609 | 8.073 |
| 19.6 | +5.940 | −5.249 | 7.927 | 7.452 |
| 19.8 | +1.055 | −4.016 | 4.152 | 4.277 |
| 20.0 | +0.000 | −0.000 | 0.000 | 0.000 |

FIG. 14

```
N = 128
Fr = 17
F1 = 14
A = .5
Pi = 4 * ATN(1)
FOR i = 0 TO 30
    Fi = F1 + i / 5
    Re = 0: Im = 0
    FOR j = 0 TO N - 1
        C = COS(2 * Pi * Fr * j / N)
        S = SIN(2 * Pi * Fr * j / N)
        P = SIN(2 * Pi * Fr * j / N)
        Q = COS(2 * Pi * Fr * j / N)
        R = A * Q + SQR(1 - A ^ 2) * P
        Re = Re + R * C
        Im = Im + R * S
    NEXT j
    Ab = SQR(Re ^ 2 + Im ^ 2)
    x = Fi - Fr
    IF x = 0 THEN
       y = 1
    ELSE
       y = SIN(Pi * x) / Pi * x)
    END IF
    Abx = ABS(N * y / 2)
    PRINT "    ";
    PRINT USING "##.# "; Fi;
    PRINT USING "+##.### "; Re; Im;
    PRINT USING "##.### "; Ab; Abx
NEXT i
END
```

FIG. 15

| Cents | s | dB |
|---|---|---|
| −100 | .000 | notch |
| −90 | 0.109 | −19.23 |
| −80 | 0.234 | −12.62 |
| −70 | 0.368 | −8.69 |
| −60 | 0.505 | −5.94 |
| −50 | 0.637 | −3.92 |
| −40 | 0.757 | −2.42 |
| −30 | 0.858 | −1.33 |
| −20 | 0.935 | −0.58 |
| −10 | 0.984 | −0.14 |
| +0 | 1.000 | +0.00 |
| +10 | 0.984 | −0.14 |
| +20 | 0.935 | −0.58 |
| +30 | 0.858 | −1.33 |
| +40 | 0.757 | −2.42 |
| +50 | 0.637 | −3.92 |
| +60 | 0.505 | −5.94 |
| +70 | 0.368 | −8.69 |
| +80 | 0.234 | −12.62 |
| +90 | 0.109 | −19.23 |
| +100 | .000 | notch |

$$s = \sin(\pi x) / (\pi x)$$
$$x = \text{Cents} / 100$$

FIG. 16

*a*

```
13280/11025 = 1.204535
Kr1 = 54/44 = 1.204545
    2^(-1/3) = .7937005
Kr2 = 50/63 = .7936508

Sr(0) = (3 * 5 * 7) ^ 2 = 11025
Sr(1) = Kr1 * Sr(0)
Sr(2) = Kr2 * Sr(1)
Sr(3) = Kr2 * Sr(2)
Sr(4) = Sr(1) / 2
Sr(5) = Sr(2) / 2
Sr(6) = Sr(3) / 2
```

*b*

```
12575/11025 = 1.14059
Kr1 = 73/64 = 1.140625
    2^(-1/2) = .7071068
Kr2 = 70/99 = .7070707

Sr(0) = (3 * 5 * 7) ^ 2 = 11025
Sr(1) = Kr1 * Sr(0)
Sr(2) = Kr2 * Sr(1)
Sr(3) = Sr(1) / 2
Sr(4) = Sr(2) / 2
```

*c*

```
11931/11025 = 1.082177
Kr1 = 79/73 = 1.082192
    2^(-2/3) = .6299605
Kr2 = 46/73 = .630137

Sr(0) = (3 * 5 * 7) ^ 2 = 11025
Sr(1) = Kr1 * Sr(0)
Sr(2) = Kr2 * Sr(1)
Sr(3) = Kr2 * Sr(2)
```

FIG. 17

```
DATA "C ", "C# ", "D ", "D# "
DATA "E ", "F ", "F# ", "G "
DATA "G# ", "A ", "A# ", "B "
DIM K$(0 TO 11)
FOR p = 0 TO 11
   READ K$(p)
NEXT p
C0 = 440 * 2 ^ (-69 / 12) = 8.175799
L2 = LOG(2) = .6931472
FOR i = 1 TO n
   ul = ul0
   ll = 35 - ul
   IF i = 1 THEN ul = ul0 + 1
   FOR Cf = ul TO ll STEP -1
      Pa = Cf * Sr(i) / 128
      Px = 12 * LOG(Pa / C0) / L2
      Pn = CINT(Px)
      Pe = C0 * 2  (Pn / 12)
      Centts = 100 * (Px - Pn)
      O = Pn \ 12 'Integer part
      p = Pn MOD 12 'Remainder
      K = K$(p)
   NEXT j
NEXT i
END
```

FIG. 18

| Sr | Cf | Pn | K | O | Pe | Pa | Cents |
|---|---|---|---|---|---|---|---|
| 13280 | 20 | 96 | C | 8 | 2093.00 | 2075.02 | −14.94 |
| 13280 | 19 | 95 | B | 7 | 1975.53 | 1971.27 | −3.74 |
| 13280 | 18 | 94 | A# | 7 | 1864.66 | 1867.52 | +2.65 |
| 13280 | 17 | 93 | A | 7 | 1760.00 | 1763.77 | +3.70 |
| 13280 | 16 | 92 | G# | 7 | 1661.22 | 1660.01 | −1.26 |
| 10540 | 19 | 91 | G | 7 | 1567.98 | 1564.50 | −3.85 |
| 10540 | 18 | 90 | F# | 7 | 1479.98 | 1482.16 | +2.55 |
| 10540 | 17 | 89 | F | 7 | 1396.91 | 1399.81 | +3.59 |
| 10540 | 16 | 88 | E | 7 | 1318.51 | 1317.47 | −1.36 |
| 8365 | 19 | 87 | D# | 7 | 1244.51 | 1241.66 | −3.96 |
| 8365 | 18 | 86 | D | 7 | 1174.66 | 1176.31 | +2.44 |
| 8365 | 17 | 85 | C# | 7 | 1108.73 | 1110.96 | +3.48 |
| 8365 | 16 | 84 | C | 7 | 1046.50 | 1045.61 | −1.47 |
| 6640 | 19 | 83 | B | 6 | 987.77 | 985.63 | −3.74 |
| 6640 | 18 | 82 | A# | 6 | 932.33 | 933.76 | +2.65 |
| 6640 | 17 | 81 | A | 6 | 880.00 | 881.88 | +3.70 |
| 6640 | 16 | 80 | G# | 6 | 830.61 | 830.01 | −1.26 |
| 5270 | 19 | 79 | G | 6 | 783.99 | 782.25 | −3.85 |
| 5270 | 18 | 78 | F# | 6 | 739.99 | 741.08 | +2.55 |
| 5270 | 17 | 77 | F | 6 | 698.46 | 699.91 | +3.59 |
| 5270 | 16 | 76 | E | 6 | 659.26 | 658.74 | −1.36 |
| 4182 | 19 | 75 | D# | 6 | 622.25 | 620.83 | −3.96 |
| 4182 | 18 | 74 | D | 6 | 587.33 | 588.16 | +2.44 |
| 4182 | 17 | 73 | C# | 6 | 554.37 | 555.48 | +3.48 |
| 4182 | 16 | 72 | C | 6 | 523.25 | 522.81 | −1.47 |

FIG. 19

| Sr | Cf | Pn | K | O | Pe | Pa | Cents |
|---|---|---|---|---|---|---|---|
| 12575 | 21 | 96 | C | 8 | 2093.00 | 2063.15 | −24.87 |
| 12575 | 20 | 95 | B | 7 | 1975.53 | 1964.90 | −9.34 |
| 12575 | 19 | 94 | A# | 7 | 1864.66 | 1866.66 | +1.86 |
| 12575 | 18 | 93 | A | 7 | 1760.00 | 1768.41 | +8.26 |
| 12575 | 17 | 92 | G# | 7 | 1661.22 | 1670.17 | +9.30 |
| 12575 | 16 | 91 | G | 7 | 1567.98 | 1571.92 | +4.35 |
| 12575 | 15 | 90 | F# | 7 | 1479.98 | 1473.68 | −7.38 |
| 8892 | 20 | 89 | F | 7 | 1396.91 | 1389.33 | −9.43 |
| 8892 | 19 | 88 | E | 7 | 1318.51 | 1319.86 | +1.77 |
| 8892 | 18 | 87 | D# | 7 | 1244.51 | 1250.39 | +8.17 |
| 8892 | 17 | 86 | D | 7 | 1174.66 | 1180.93 | +9.21 |
| 8892 | 16 | 85 | C# | 7 | 1108.73 | 1111.46 | +4.26 |
| 8892 | 15 | 84 | C | 7 | 1046.50 | 1041.99 | −7.47 |
| 6288 | 20 | 83 | B | 6 | 987.77 | 982.45 | −9.34 |
| 6288 | 19 | 82 | A# | 6 | 932.33 | 933.33 | +1.86 |
| 6288 | 18 | 81 | A | 6 | 880.00 | 884.21 | +8.26 |
| 6288 | 17 | 80 | G# | 6 | 830.61 | 835.08 | +9.30 |
| 6288 | 16 | 79 | G | 6 | 783.99 | 785.96 | +4.35 |
| 6288 | 15 | 78 | F# | 6 | 739.99 | 736.84 | −7.38 |
| 4446 | 20 | 77 | F | 6 | 698.46 | 694.66 | −9.43 |
| 4446 | 19 | 76 | E | 6 | 659.26 | 659.93 | +1.77 |
| 4446 | 18 | 75 | D# | 6 | 622.25 | 625.20 | +8.17 |
| 4446 | 17 | 74 | D | 6 | 587.33 | 590.46 | +9.21 |
| 4446 | 16 | 73 | C# | 6 | 554.37 | 555.73 | +4.26 |
| 4446 | 15 | 72 | C | 6 | 523.25 | 521.00 | −7.47 |

FIG. 20

| Sr | Cf | Pn | K | O | Pe | Pa | Cents |
|---|---|---|---|---|---|---|---|
| 11931 | 22 | 96 | C | 8 | 2093.00 | 2050.67 | −35.38 |
| 11931 | 21 | 95 | B | 7 | 1975.53 | 1957.46 | −15.91 |
| 11931 | 20 | 94 | A# | 7 | 1864.66 | 1864.24 | −0.38 |
| 11931 | 19 | 93 | A | 7 | 1760.00 | 1771.03 | +10.82 |
| 11931 | 18 | 92 | G# | 7 | 1661.22 | 1677.82 | +17.21 |
| 11931 | 17 | 91 | G | 7 | 1567.98 | 1584.61 | +18.26 |
| 11931 | 16 | 90 | F# | 7 | 1479.98 | 1491.40 | +13.30 |
| 11931 | 15 | 89 | F | 7 | 1396.91 | 1398.18 | +1.57 |
| 11931 | 14 | 88 | E | 7 | 1318.51 | 1304.97 | −17.87 |
| 7518 | 21 | 87 | D# | 7 | 1244.51 | 1233.47 | −15.43 |
| 7518 | 20 | 86 | D | 7 | 1174.66 | 1174.73 | +0.10 |
| 7518 | 19 | 85 | C# | 7 | 1108.73 | 1115.99 | +11.30 |
| 7518 | 18 | 84 | C | 7 | 1046.50 | 1057.26 | +17.70 |
| 7518 | 17 | 83 | B | 6 | 987.77 | 998.52 | +18.75 |
| 7518 | 16 | 82 | A# | 6 | 932.33 | 939.78 | +13.79 |
| 7518 | 15 | 81 | A | 6 | 880.00 | 881.05 | +2.06 |
| 7518 | 14 | 80 | G# | 6 | 830.61 | 822.31 | −17.38 |
| 4738 | 21 | 79 | G | 6 | 783.99 | 777.25 | −14.94 |
| 4738 | 20 | 78 | F# | 6 | 739.99 | 740.24 | +0.59 |
| 4738 | 19 | 77 | F | 6 | 698.46 | 703.23 | +11.79 |
| 4738 | 18 | 76 | E | 6 | 659.26 | 666.22 | +18.18 |
| 4738 | 17 | 75 | D# | 6 | 622.25 | 629.20 | +19.23 |
| 4738 | 16 | 74 | D | 6 | 587.33 | 592.19 | +14.27 |
| 4738 | 15 | 73 | C# | 6 | 554.37 | 555.18 | +2.54 |
| 4738 | 14 | 72 | C | 6 | 523.25 | 518.17 | −16.90 |

FIG. 22A

```
A = 1 - x
B = x
Yx = A*Ya + B*Yb
```

FIG. 22B

```
A = (x - 1) * (x - 2) / 2
B = x * (x - 2) / -1
C = x * (x - 1) / 2
Yx = A*Ya + B*Yb + C*Yc
```

FIG. 22C

```
A = (x - 1) * (x - 2) * (x - 3) / -6
B = x * (x - 2) * (x - 3) / 2
C = x * (x - 1) * (x - 3) / -2
D = x * (x - 1) * (x - 2) / 6
Yx = A*Ya + B*Yb + C*Yc + D*Yd
```

FIG. 23

INTERPOLATION COEFFICIENTS

| i | j | x | k(j) | k(j+1) | k(j+2) | k(j+3) |
|---|---|---|---|---|---|---|
| 0 | −1 | 1.70690 | −.04465 | +.32347 | +.78013 | −.05894 |
| 1 | 1 | 1.12069 | −.03324 | +.92597 | +.12709 | −.01982 |
| 2 | 2 | 1.53448 | −.06077 | +.52343 | +.60098 | −.06363 |
| 3 | 3 | 1.94828 | −.00860 | +.05299 | +.97153 | −.01593 |
| 4 | 5 | 1.36207 | −.06305 | +.71160 | +.40388 | −.05243 |
| 5 | 6 | 1.77586 | −.03548 | +.24363 | +.84332 | −.05147 |
| 6 | 8 | 1.18966 | −.04637 | +.87261 | +.20423 | −.03047 |
| 7 | 9 | 1.60345 | −.05570 | +.44400 | +.67565 | −.06395 |
| 8 | 11 | 1.01724 | −.00560 | +.99108 | +.01739 | −.00287 |
| 9 | 12 | 1.43103 | −.06413 | +.63873 | +.48389 | −.05849 |
| 10 | 13 | 1.84483 | −.02524 | +.16534 | +.90020 | −.04031 |
| 11 | 15 | 1.25862 | −.05565 | +.81245 | +.28341 | −.04022 |
| 12 | 16 | 1.67241 | −.04874 | +.36367 | +.74647 | −.06140 |
| 13 | 18 | 1.08621 | −.02513 | +.94979 | +.08960 | −.01426 |
| 14 | 18 | 1.50000 | −.06250 | +.56250 | +.56250 | −.06250 |
| 15 | 20 | 1.91379 | −.01426 | +.08960 | +.94979 | −.02513 |
| 16 | 22 | 1.32759 | −.06140 | +.74647 | +.36367 | −.04874 |
| 17 | 23 | 1.74138 | −.04022 | +.28341 | +.81245 | −.05565 |
| 18 | 25 | 1.15517 | −.04031 | +.90020 | +.16534 | −.02524 |
| 19 | 26 | 1.56897 | −.05849 | +.48389 | +.63873 | −.06413 |
| 20 | 27 | 1.98276 | −.00287 | +.01739 | +.99108 | −.00560 |
| 21 | 29 | 1.39655 | −.06395 | +.67565 | +.44400 | −.05570 |
| 22 | 30 | 1.81034 | −.03047 | +.20423 | +.87261 | −.04637 |
| 23 | 32 | 1.22414 | −.05147 | +.84332 | +.24363 | −.03548 |
| 24 | 33 | 1.63793 | −.05243 | +.40388 | +.71160 | −.06305 |
| 25 | 35 | 1.05172 | −.01593 | +.97153 | +.05299 | −.00860 |
| 26 | 36 | 1.46552 | −.06363 | +.60098 | +.52343 | −.06077 |
| 27 | 37 | 1.87931 | −.01982 | +.12709 | +.92597 | −.03324 |
| 28 | 39 | 1.29310 | −.05894 | +.78013 | +.32347 | −.04465 |

FIG. 24

NORMALIZED COEFFICIENTS

| i | j | k0 | k1 | k2 | k3 | j | i |
|---|---|---|---|---|---|---|---|
| 0 | −1 | −6 | 41 | 100 | −8 | −1 | 0 |
| 1 | 1 | −4 | 119 | 16 | −3 | 1 | 1 |
| 2 | 2 | −8 | 67 | 77 | −8 | 2 | 2 |
| 3 | 3 | −1 | 7 | 124 | −2 | 3 | 3 |
| 4 | 5 | −8 | 91 | 52 | −7 | 5 | 4 |
| 5 | 6 | −5 | 31 | 108 | −7 | 6 | 5 |
| 6 | 8 | −6 | 112 | 26 | −4 | 8 | 6 |
| 7 | 9 | −7 | 57 | 86 | −8 | 9 | 7 |
| 8 | 11 | −1 | 127 | 2 | +0 | 11 | 8 |
| 9 | 12 | −8 | 82 | 62 | −7 | 12 | 9 |
| 10 | 13 | −3 | 21 | 115 | −5 | 13 | 10 |
| 11 | 15 | −7 | 104 | 36 | −5 | 15 | 11 |
| 12 | 16 | −6 | 47 | 96 | −8 | 16 | 12 |
| 13 | 18 | −3 | 122 | 11 | −2 | 18 | 13 |
| 14 | 18 | −8 | 72 | 72 | −8 | 19 | 14 |
| 15 | 20 | −2 | 11 | 122 | −3 | 20 | 15 |
| 16 | 22 | −8 | 96 | 47 | −6 | 22 | 16 |
| 17 | 23 | −5 | 36 | 104 | −7 | 23 | 17 |
| 18 | 25 | −5 | 115 | 21 | −3 | 25 | 18 |
| 19 | 26 | −7 | 62 | 82 | −8 | 26 | 19 |
| 20 | 27 | +0 | 2 | 127 | −1 | 27 | 20 |
| 21 | 29 | −8 | 86 | 57 | −7 | 29 | 21 |
| 22 | 30 | −4 | 26 | 112 | −6 | 30 | 22 |
| 23 | 32 | −7 | 108 | 31 | −5 | 32 | 23 |
| 24 | 33 | −7 | 52 | 91 | −8 | 33 | 24 |
| 25 | 35 | −2 | 124 | 7 | −1 | 35 | 25 |
| 26 | 36 | −8 | 77 | 67 | −8 | 36 | 26 |
| 27 | 37 | −3 | 16 | 119 | −4 | 37 | 27 |
| 28 | 39 | −8 | 100 | 41 | −6 | 39 | 28 |

FIG. 26

| | j = 0 | j = 1 | j = 2 |
|---|---|---|---|
| i = 0 | 104.009 | 82.5472 | 65.5136 |
| i = 1 | 52.0047 | 41.2736 | 32.7568 |
| i = 2 | 26.0024 | 20.6368 | 16.3784 |
| i = 3 | 13.0012 | 10.3184 | 8.18920 |
| i = 4 | 6.50059 | 5.15920 | 4.09460 |

FIG. 27

RESPONSE PITCHES

| Cf | Fs | Pitch | Cf | Fs | Pitch |
|---|---|---|---|---|---|
| 16 | 4.09460 | 65.5136 | 18 | 20.6368 | 371.462 |
| 17 | 4.09460 | 69.6082 | 19 | 20.6368 | 392.099 |
| 18 | 4.09460 | 73.7028 | 16 | 26.0024 | 416.038 |
| 19 | 4.09460 | 77.7974 | 17 | 26.0024 | 442.040 |
| 16 | 5.15920 | 82.5472 | 18 | 26.0024 | 468.042 |
| 17 | 5.15920 | 87.7064 | 19 | 26.0024 | 494.045 |
| 18 | 5.15920 | 92.8656 | 16 | 32.7568 | 524.109 |
| 19 | 5.15920 | 98.0248 | 17 | 32.7568 | 556.866 |
| 16 | 6.50059 | 104.009 | 18 | 32.7568 | 589.623 |
| 17 | 6.50059 | 110.510 | 19 | 32.7568 | 622.379 |
| 18 | 6.50059 | 117.011 | 16 | 41.2736 | 660.377 |
| 19 | 6.50059 | 123.511 | 17 | 41.2736 | 701.651 |
| 16 | 8.18920 | 131.027 | 18 | 41.2736 | 742.925 |
| 17 | 8.18920 | 139.216 | 19 | 41.2736 | 784.198 |
| 18 | 8.18920 | 147.406 | 16 | 52.0047 | 832.076 |
| 19 | 8.18920 | 155.595 | 17 | 52.0047 | 884.080 |
| 16 | 10.3184 | 165.094 | 18 | 52.0047 | 936.085 |
| 17 | 10.3184 | 175.413 | 19 | 52.0047 | 988.090 |
| 18 | 10.3184 | 185.731 | 16 | 65.5136 | 1048.22 |
| 19 | 10.3184 | 196.050 | 17 | 65.5136 | 1113.73 |
| 16 | 13.0012 | 208.019 | 18 | 65.5136 | 1179.25 |
| 17 | 13.0012 | 221.020 | 19 | 65.5136 | 1244.76 |
| 18 | 13.0012 | 234.021 | 16 | 82.5472 | 1320.75 |
| 19 | 13.0012 | 247.022 | 17 | 82.5472 | 1403.30 |
| 16 | 16.3784 | 262.055 | 18 | 82.5472 | 1485.85 |
| 17 | 16.3784 | 278.433 | 19 | 82.5472 | 1568.40 |
| 18 | 16.3784 | 294.811 | 16 | 104.009 | 1664.15 |
| 19 | 16.3784 | 311.190 | 17 | 104.009 | 1768.16 |
| 16 | 20.6368 | 330.189 | 18 | 104.009 | 1872.17 |
| 17 | 20.6368 | 350.825 | 19 | 104.009 | 1976.18 |
| 18 | 20.6368 | 371.462 | 20 | 104.009 | 2080.19 |

FIG. 28

| Fr | Mn | Cents | Fr | Mn | Cents |
|---|---|---|---|---|---|
| 65.5136 | 36 | +2.836 | 371.462 | 66 | +6.854 |
| 69.6082 | 37 | +7.792 | 392.099 | 67 | +0.458 |
| 73.7028 | 38 | +6.746 | 416.038 | 68 | +3.053 |
| 77.7974 | 39 | +0.349 | 442.040 | 69 | +8.009 |
| 82.5472 | 40 | +2.945 | 468.042 | 70 | +6.963 |
| 87.7064 | 41 | +7.900 | 494.045 | 71 | +0.566 |
| 92.8656 | 42 | +6.855 | 524.109 | 72 | +2.836 |
| 98.0248 | 43 | +0.457 | 556.866 | 73 | +7.791 |
| 104.009 | 44 | +3.053 | 589.623 | 74 | +6.746 |
| 110.510 | 45 | +8.008 | 622.379 | 75 | +0.349 |
| 117.011 | 46 | +6.963 | 660.377 | 76 | +2.944 |
| 123.511 | 47 | +0.566 | 701.651 | 77 | +7.899 |
| 131.027 | 48 | +2.836 | 742.925 | 78 | +6.854 |
| 139.216 | 49 | +7.792 | 784.198 | 79 | +0.458 |
| 147.406 | 50 | +6.746 | 832.076 | 80 | +3.053 |
| 155.595 | 51 | +0.349 | 884.080 | 81 | +8.009 |
| 165.094 | 52 | +2.945 | 936.085 | 82 | +6.963 |
| 175.413 | 53 | +7.900 | 988.090 | 83 | +0.566 |
| 185.731 | 54 | +6.855 | 1048.22 | 84 | +2.836 |
| 196.050 | 55 | +0.457 | 1113.73 | 85 | +7.791 |
| 208.019 | 56 | +3.053 | 1179.25 | 86 | +6.746 |
| 221.020 | 57 | +8.008 | 1244.76 | 87 | +0.349 |
| 234.021 | 58 | +6.963 | 1320.75 | 88 | +2.944 |
| 247.022 | 59 | +0.566 | 1403.30 | 89 | +7.899 |
| 262.055 | 60 | +2.836 | 1485.85 | 90 | +6.854 |
| 278.433 | 61 | +7.792 | 1568.40 | 91 | +0.458 |
| 294.811 | 62 | +6.746 | 1664.15 | 92 | +3.053 |
| 311.190 | 63 | +0.349 | 1768.16 | 93 | +8.009 |
| 330.189 | 64 | +2.944 | 1872.17 | 94 | +6.963 |
| 350.825 | 65 | +7.899 | 1976.18 | 95 | +0.566 |
| 371.462 | 66 | +6.854 | 2080.19 | 96 | −10.633 |

FLOW CHART

FLOW CHART

FIG. 32

PSEUDO WAVE FILES

| FILE | RATE |
|---|---|
| PSEUDO WAVE 7.5 | 12575.51 |
| PSEUDO WAVE 7.0 | 8892.23 |
| PSEUDO WAVE 6.5 | 6287.75 |
| PSEUDO WAVE 6.0 | 4446.12 |
| PSEUDO WAVE 5.5 | 3143.88 |
| PSEUDO WAVE 5.0 | 2223.06 |
| PSEUDO WAVE 4.5 | 1571.94 |
| PSEUDO WAVE 4.0 | 1111.53 |
| PSEUDO WAVE 3.5 | 785.97 |
| PSEUDO WAVE 3.0 | 555.76 |
| PSEUDO WAVE 2.5 | 392.98 |
| PSEUDO WAVE 2.0 | 277.88 |

*FIG. 33*

HALF-TONE FILES

| | | | |
|---|---|---|---|
| PSEUDO WAVE 7.5 | | | |
| HALF TONE | 96 | C | 8 |
| HALF TONE | 95 | B | 7 |
| HALF TONE | 94 | A# | 7 |
| HALF TONE | 93 | A | 7 |
| HALF TONE | 92 | G# | 7 |
| HALF TONE | 91 | G | 7 |
| HALF TONE | 90 | F# | 7 |
| PSEUDO WAVE 7.0 | | | |
| HALF TONE | 89 | F | 7 |
| HALF TONE | 88 | E | 7 |
| HALF TONE | 87 | D# | 7 |
| HALF TONE | 86 | D | 7 |
| HALF TONE | 85 | C# | 7 |
| HALF TONE | 84 | C | 7 |
| PSEUDO WAVE 6.5 | | | |
| HALF TONE | 83 | B | 6 |
| HALF TONE | 82 | A# | 6 |
| HALF TONE | 81 | A | 6 |
| HALF TONE | 80 | G# | 6 |
| HALF TONE | 79 | G | 6 |
| HALF TONE | 78 | F# | 6 |
| PSEUDO WAVE 6.0 | | | |
| HALF TONE | 77 | F | 6 |
| HALF TONE | 76 | E | 6 |
| HALF TONE | 75 | D# | 6 |
| HALF TONE | 74 | D | 6 |
| HALF TONE | 73 | C# | 6 |
| HALF TONE | 72 | C | 6 |

HALF-TONE FILES

| | | | |
|---|---|---|---|
| PSEUDO WAVE 5.5 | | | |
| HALF TONE | | | 5 |
| HALF TONE | 71 | B | 5 |
| HALF TONE | 79 | A# | 5 |
| HALF TONE | 69 | A | 5 |
| HALF TONE | 68 | G# | 5 |
| HALF TONE | 67 | G | 5 |
| HALF TONE | 66 | F# | 5 |
| PSEUDO WAVE 5.0 | | | |
| HALF TONE | 65 | F | 5 |
| HALF TONE | 64 | E | 5 |
| HALF TONE | 63 | D# | 5 |
| HALF TONE | 62 | D | 5 |
| HALF TONE | 61 | C# | 5 |
| HALF TONE | 60 | C | 5 |
| PSEUDO WAVE 4.5 | | | |
| HALF TONE | 59 | B | 4 |
| HALF TONE | 58 | A# | 4 |
| HALF TONE | 57 | A | 4 |
| HALF TONE | 56 | G# | 4 |
| HALF TONE | 55 | G | 4 |
| HALF TONE | 54 | F# | 4 |
| PSEUDO WAVE 4.0 | | | |
| HALF TONE | 53 | F | 4 |
| HALF TONE | 52 | E | 4 |
| HALF TONE | 51 | D# | 4 |
| HALF TONE | 50 | D | 4 |
| HALF TONE | 49 | C# | 4 |
| HALF TONE | 48 | C | 4 |

HALF-TONE FILES

| | | | |
|---|---|---|---|
| PSEUDO WAVE 3.5 | | | |
| HALF TONE | | | 3 |
| HALF TONE | 47 | B | 3 |
| HALF TONE | 46 | A# | 3 |
| HALF TONE | 45 | A | 3 |
| HALF TONE | 44 | G# | 3 |
| HALF TONE | 43 | G | 3 |
| HALF TONE | 42 | F# | 3 |
| PSEUDO WAVE 3.0 | | | |
| HALF TONE | 41 | F | 3 |
| HALF TONE | 40 | E | 3 |
| HALF TONE | 39 | D# | 3 |
| HALF TONE | 38 | D | 3 |
| HALF TONE | 37 | C# | 3 |
| HALF TONE | 36 | C | 3 |
| PSEUDO WAVE 2.5 | | | |
| HALF TONE | 35 | B | 2 |
| HALF TONE | 34 | A# | 2 |
| HALF TONE | 33 | A | 2 |
| HALF TONE | 32 | G# | 2 |
| HALF TONE | 31 | G | 2 |
| HALF TONE | 30 | F# | 2 |
| PSEUDO WAVE 2.0 | | | |
| HALF TONE | 29 | F | 2 |
| HALF TONE | 28 | E | 2 |
| HALF TONE | 27 | D# | 2 |
| HALF TONE | 26 | D | 2 |
| HALF TONE | 25 | C# | 2 |
| HALF TONE | 24 | C | |

METHOD AND SYSTEM FOR CREATING MUSICAL SCORES FROM MUSICAL RECORDINGS

CROSS-REFERENCE TO RELATED APPLICATIONS

This application claims priority from U.S. Provisional application No. 60/149,790, filed Aug. 19, 1999.

FIELD OF THE INVENTION

The present invention relates generally to methods and systems for obtaining a musical score from a musical recording and, more particularly, to a method and system for creating computer files from a digital musical recording.

BACKGROUND OF THE INVENTION

Musical Instrument Digital Interface, MIDI, is a digital communication protocol, which allows interworking between musical instruments by providing a link which is capable of transmitting and receiving digital data or instructions for creating music. The MIDI specification includes a common language that provides information about events, such as turning on and off notes, expresses the velocity of each note, and provides the timing relationships of all MIDI notes and events. A standard MIDI file is used to transfer MIDI information from a musical instrument to another device. Generally, a MIDI sequencer file is transferred to a standard MIDI file which, in turn, gets interpreted by a notation program.

MIDI sequences typically allow the user to input data in two ways: (1) real time recording, where incoming data is recorded as the performer plays on an instrument having a MIDI controller; and (2) step time recording, which allows the performer to input notes of events one step at a time from the controller, or using a computer keyboard or mouse. A notation program allows the user to create a full score of a composition and to extract individual parts with transposition for individual instruments. However, in order for the user to print out a musical score of a composition, the performer must input the musical notes using a musical instrument which includes the MIDI controller or the MIDI port.

Accordingly, a process which enables the user to obtain a musical score of a composition without requiring a musical instrument with the MIDI controller is desirable. Such a process preferably would generate a standard MIDI file from a digital recording and would not require a musical instrument having the MIDI controller.

SUMMARY OF THE INVENTION

In one embodiment, the present invention provides a method and system for obtaining a musical score from a musical recording. In another embodiment, the present invention also provides a method and system for creating an editable music file from a musical recording, such that a user may modify the musical recording and obtain a musical score from the modified musical recording. An exemplary method comprises any two or more of the steps: (1) storing a digital musical recording as a wave file; (2) generating a pseudo wave file for each octave segment of interest from the wave file; (3) generating a half-tone or other sequence file for each of the pseudo wave files; (4) generating a list of events from the sequence file; (5) converting the list of events from the sequence file into a MIDI file or other notation program readable file that can be imported into a notation program; and, (6) importing the MIDI or other file into the notation program in order to print the musical score.

The computer files which may be configured as a standard MIDI file, may be read by a notation program or a MIDI sequencer program to allow a user to create a full score of a composition or to extract the individual parts. The user is no longer required to use a musical instrument with a MIDI port, or the like, to obtain a musical score of a composition.

In an exemplary embodiment, the list of events generated from the sequence file is configured as a standard MIDI file with a song header, a track header, and a series of note events, by sorting the events by time, rather than by tone, and observing MIDI conventions. The standard MIDI file may be read by another notation program or a MIDI sequencer program. According to other exemplary embodiments, any of various conventional notation program readable files other than MIDI may be used.

In another exemplary embodiment, the list of events may be used as an editable file where a user can edit or modify the musical recording from its original form prior to converting the an event list to a notation program readable file such as MIDI. After the modification, the file is configured as a standard MIDI or other notation program readable file as described above. The standard MIDI file may be read by another notation program or a MIDI sequencer program. A user may use this exemplary embodiment to create a full score of a composition or to simply extract individual parts of a musical piece.

DESCRIPTION OF THE DRAWINGS

FIG. 2 is a table of pitch characteristics of sixty-one notes of a keyboard of an organ manual;

FIG. 3 is a Quick BASIC (Beginners All Purpose Symbolic Instruction Code—Microsoft version) code used to generate the table in FIG. 2;

FIG. 4 is a table listing an octave normalized with respect to the top octave of FIG. 2;

FIG. 7 is a table which lists data comparing the straight line of FIG. 6 with the curve of FIG. 5;

FIG. 9 is a table which lists data comparing the two-segment approximation of FIG. 8 with the curve of FIG. 5;

FIG. 11 is a table which lists data comparing the three-segment approximation of FIG. 10 with the curve of FIG. 5;

FIG. 13 is a table listing pitches which vary from three half-tones below and above 17 cycles per frame;

FIG. 14 shows an exemplary computer code used to generate the table in FIG. 13;

FIG. 15 is a table listing the filter characteristics of the single transformed pitch at 17 cycles per frame;

FIG. 16 lists calculations for determining sample rates for three cases;

FIG. 17 shows a list of functions used to generate the tables shown in FIGS. 18, 19, and 20;

FIG. 18 is a table listing pitch characteristics of a 4 half-tones per segment embodiment;

FIG. 19 is a table listing pitch characteristics of a 6 half-tones per segment embodiment;

FIG. 20 is a table listing pitch characteristics of an 8 half-tones per segment embodiment;

FIGS. 22A, 22B, and 22C each provide a list of polynomial equations used to generate the set of curves shown in FIGS. 21A, 21B, and 21C, respectively;

FIG. 23 is a table of interpolation coefficients;

FIG. 24 is a table showing normalized interpolation coefficients;

FIG. 26 is a table which lists frame rates for various conditions;

Figure 29:
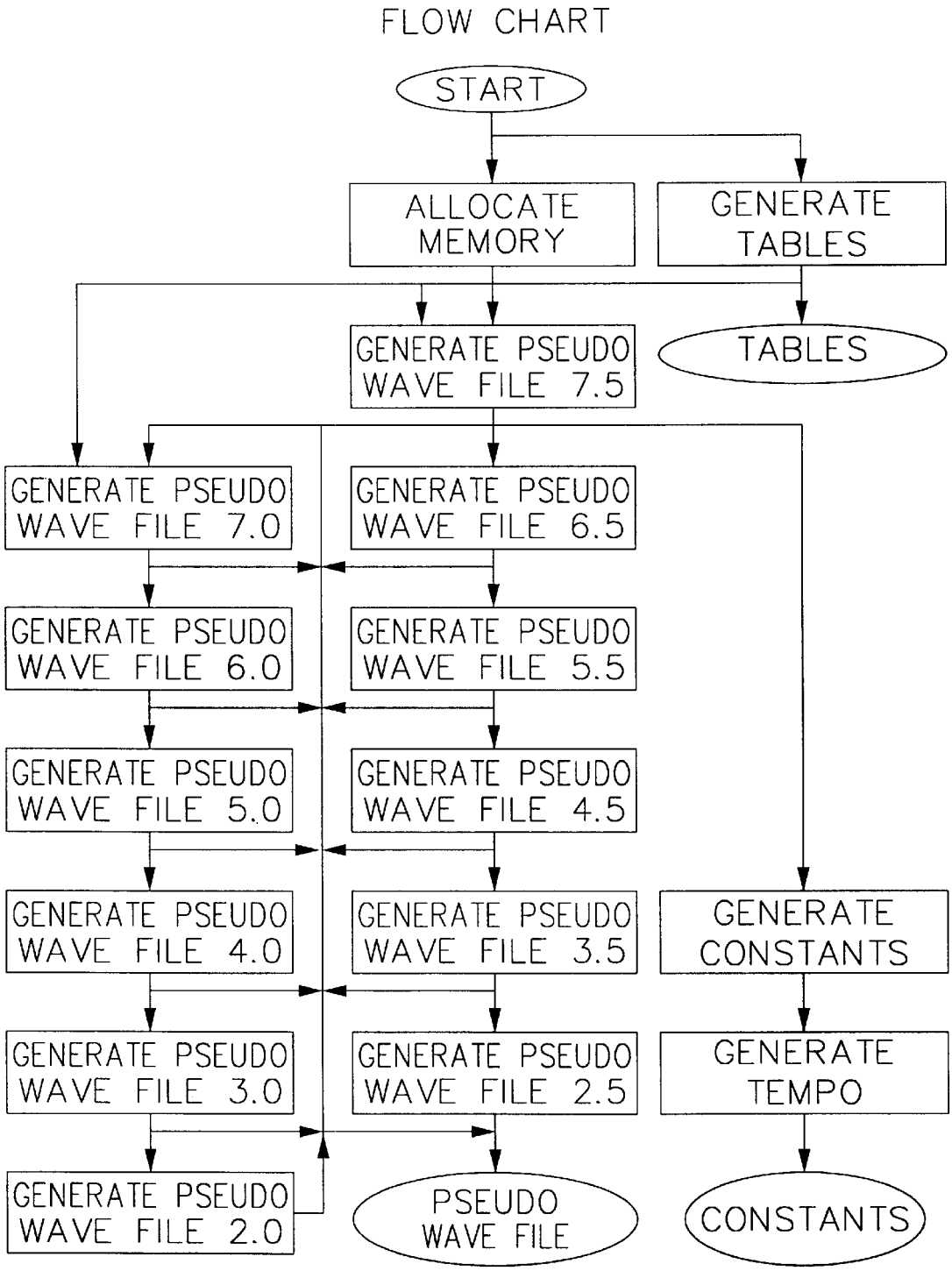
Figure 30:
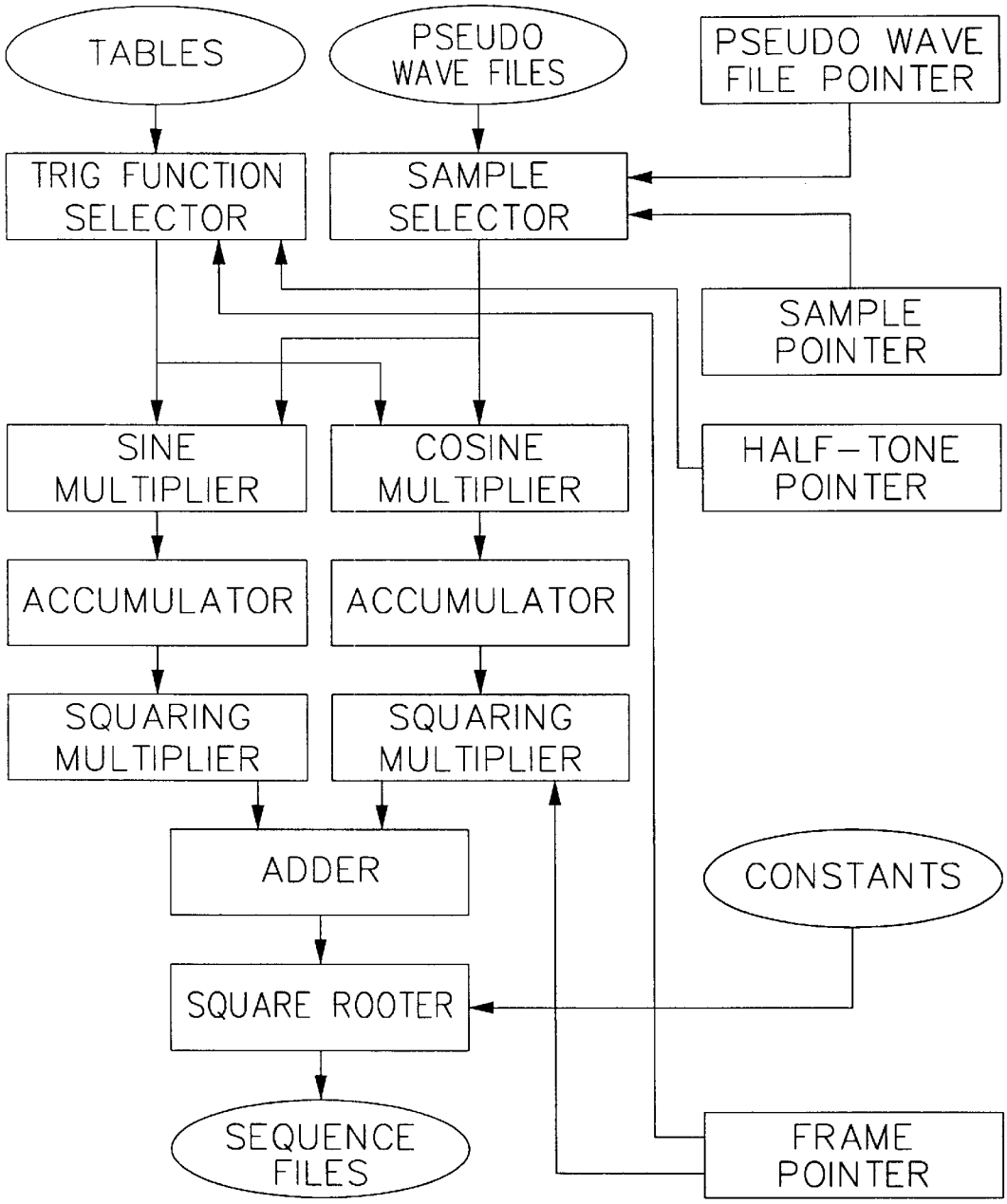
Figure 31:
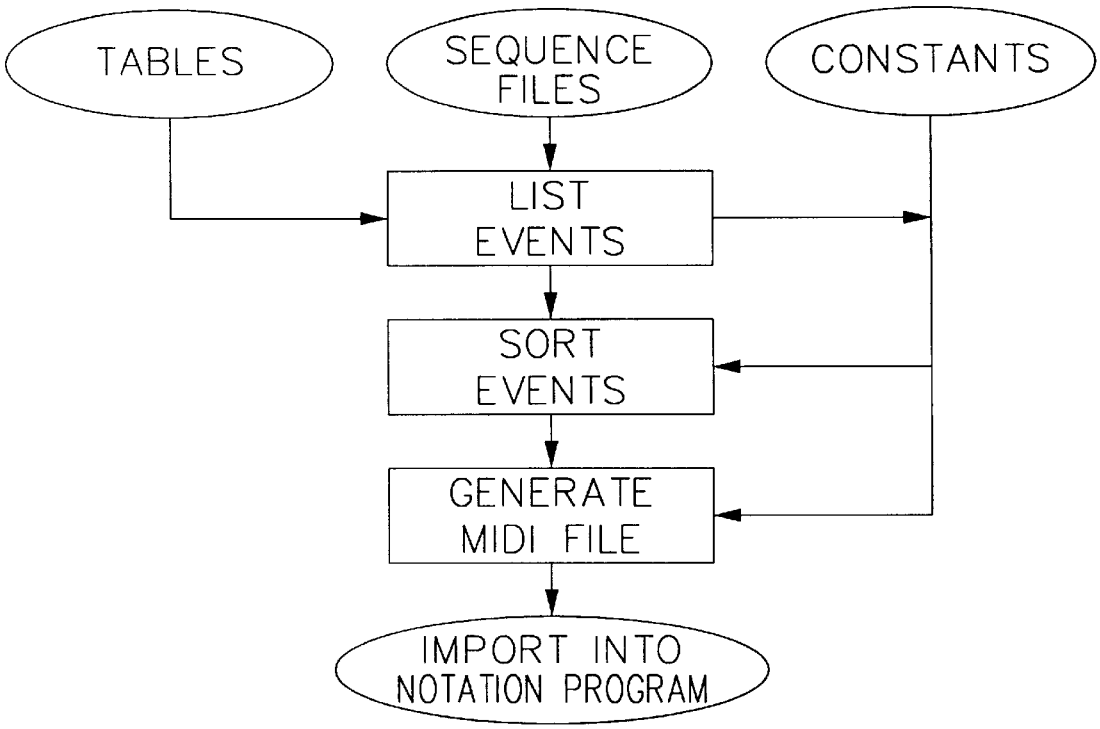

F1G. 27 is a table listing response pitches of the notes;

FIG. 28 is a table listing the discrepancies of the response pitches in cents;

FIG. 29 is a flow chart showing the generation of pseudo wave files;

FIG. 30 is a flow chart following FIG. 29, and which shows the generation of sequence files from pseudo wave files;

FIG. 31 is a flow chart following FIG. 30, and which shows the generation of a MIDI file from the sequence files;

FIG. 32 is a table of pseudo wave files; and

FIG. 33 is a table of half-tone files.

DETAILED DESCRIPTION OF THE INVENTION

The present invention provides a system and method for creating a musical score from a musical recording. The present invention also provides a method and system for creating an editable music file from a musical recording, such that a user may modify the musical recording and obtain a musical score from the modified musical recording.

As will be understood by one having skill in the art, Musical Instrument Digital Interface, MIDI, is a digital communication protocol which allows interworking between musical instruments by providing a link that is capable of transmitting and receiving digital data or instructions for creating music. The MIDI specification includes a common language that provides information about events, such as turning on and off notes, it expresses the velocity of each note, and it describes the timing relationships of all MIDI notes and events. A standard MIDI file is used to transfer MIDI information from one type of device to another. Generally, a MIDI sequencer file is transferred to a standard MIDI file, which then gets interpreted by a notation program.

MIDI sequences allow the user to input data in two ways:
(1) real time recording, where incoming data is recorded as the performer plays on an instrument having a MIDI controller; and
(2) step time recording, which allows the performer to input notes of events one step at a time from the controller or a computer keyboard or mouse. A notation program allows the user to create and print out a full score of a composition and also allows the user to extract the individual parts with transposition for individual instruments. Therefore, according to the conventional art, in order for the user to print out a musical score of a composition, the performer must input the musical notes by using a musical instrument with the MIDI controller or by inputting the notes one step at a time.

The musical spectrum is divided into octaves. Each octave consists of a series of 12 half-tones. The $13^{th}$ is the first half-tone of the next octave. Each octave is divided into segments. In the present invention, a digital recording or wave file is used to produce pseudo wave files. A pseudo wave file is produced for each octave segment of interest, as will be described below. A sample is a number indicating the instantaneous amplitude of a sound wave and is a signal integer. Current conventions include 1, 2, and 3-byte numbers. The sample rate of each pseudo wave file is proportional to the pitch of its segment. Conventional sample rates are 11025, 22050 and 44100 samples/second. A pseudo wave file is produced by interpolating among the actual samples of the wave file or the partially generated pseudo wave file.

Figure 1:
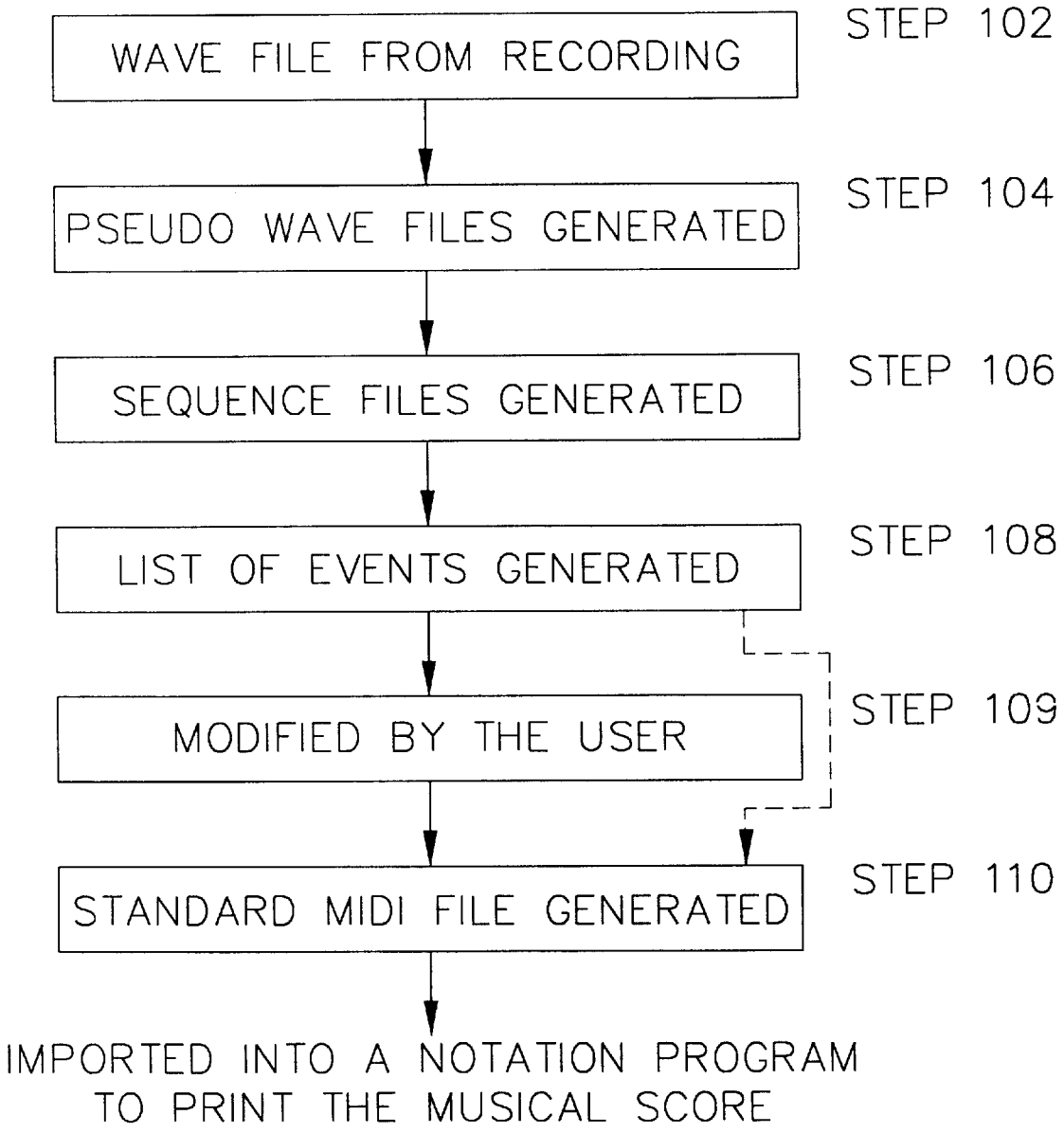
FIG. 1 is a flowchart showing the sequence of creating a musical score from musical recording according to an exemplary embodiment of the present invention.

Now turning to the figures, FIG. 1 provides a block diagram showing the sequence of the method for obtaining a musical score and an editable computer file from a musical recording, without requiring the use of a musical instrument having a MIDI port or controller. FIG. 1 is a flow chart which shows a digital recording of music stored as a wave file in step 102. The wave file includes a header and samples, where samples are related to regular intervals of time. The header is the initial data in the wave file. Current convention uses eleven groups of four bytes of alpha-numeric characters or 32-bit numbers in the header.

In ascending order, each half-tone of an octave has a pitch related to the pitch of its predecessor of 2 raised to the 1/12th power. Each octave may be divided into segments, which are known as octave segments. According to various exemplary embodiments, an octave may include four segments with three half-tones per segment; three segments with four half-tones per segment; two segments with six half-tones per segment; or one segment with twelve half-tones per segment. In the present invention, an octave number is defined as the integer part of the MIDI pitch number, divided by 12. Stated alternatively, the octave number as defined, is one greater than the conventional octave number designation. According to other exemplary embodiments in which a notation program readable language other than MIDI is used, the octave number may be defined differently.

By sampling one octave segment of the wave file in step 102, a pseudo wave file is generated at step 104 for the corresponding octave segment of interest. A sample is a signed integer indicating the instantaneous amplitude of the musical wave. Current conventions include 1, 2, and 3-byte numbers.

Pseudo wave files shown at step 104 are generated for each portion of the wave file. In an exemplary embodiment a portion may be an octave segment of interest. In one embodiment, five octaves are selected with each octave having three octave segments of four half-tone segments each. As such there are fifteen octave segments of interest and fifteen pseudo wave files are created in this embodiment. A pseudo wave file has a file or an array similar to the wave file. However, a pseudo wave file differs from a wave file as it may lack a standard header, and it may not have a standard sample rate. Also, the pseudo wave file may not have standard sample resolution.

The sample rate of the pseudo wave file is proportional to the pitch of its octave segment. Conventional sampling rates for musical recordings include 11025, 22050 and 44100 samples per second but other rates may be used alternatively. As such, the sample rate for the pseudo wave file may be 11025, 22050 or 44100 samples per second according to conventional exemplary embodiments. The length of each pseudo wave file in step 104 is measured in analysis frames, or simply, frames, where each frame consists of approximately seventy five to two hundred samples. In an exemplary embodiment, 128 samples per frame may be used. The samples in each pseudo wave file are approximated by interpolating among samples of the existing wave file in step 102, or among samples from existing pseudo wave files in step 104.

A pseudo wave file representing an octave segment generates a series of pitch coefficients which represent each frame and each half-tone in the segment. These coefficients from the pseudo wave files create sequence files in step 106 according to the method described below. A sequence file is a file or array of pitch coefficients. In one embodiment, the sequence file is created by transforming the pseudo wave file, which is in the time domain, to a file in the pitch domain utilizing the Fourier response of a sinusoid. In the preferred embodiment, the sequence file is a half-tone file.

A list of events is then generated from the data in each of the sequence (half-tone) files in step 108. An event is the beginning or ending of a musical note. Event data includes (1) identity of half-tone, (2) attack or release velocity, (3) relative time of occurrence, and (4) whether the event is an attack or release event. A series of events are listed by the octave segment of interest. The list of events may be modified by the user such as shown at step 109. According to another exemplary embodiment, step 109 may be bypassed (as shown by the dashed line) and the event list not modified.

According to an exemplary embodiment, the original or modified list of events creates a standard MIDI file with a song header, a track header, and a series of note events by sorting the events by time, rather than by tone, and observing MIDI conventions such as shown at step 110. The list of events may alternatively create another notation program readable file, not in MIDI format. Any of various conventional notation program readable files may be used. The standard MIDI file from step 110 is imported into a notation program where it can be read by a notation program or a MIDI sequencer program. Some programs allow a user to create and extract a full score of a composition, as well as extracting the individual parts. The musical score may then be printed from the notation program file.

A normalized pitch response used in generating the sequence or half-tone file from the pseudo wave file as in step 106 may be approximated by straight lines. A Fourier response to a sinusoid may be used to approximate the pitch response according to an exemplary embodiment as will be described below. In FIG. 2, sixty-one notes of a keyboard of an organ manual (8 ft registration) are listed along with the generated pitch response. Column heading MN represents MIDI pitch number; column heading K represents musical note designation; column heading O represents octave number; and column heading P represents pitch in Hertz. A pitch number is assigned to each half-tone. The pitch of a half-tone is 1.0595 times the pitch of a half-tone: immediately below it. The interval between consecutive pitch numbers can be divided into 100 parts, where the parts are called cents or pennies. Cents are an offset or a discrepancy percent of a half-tone interval. The pitch is for an equally tempered scale based on A5 440 (Hz).

FIG. 3 is a Quick BASIC (Beginners All Purpose Symbolic Instruction Code; a Microsoft version) code used to generate the table in FIG. 2. Other codes may be alternatively used to generate the table shown in FIG. 2. Variables in the Quick BASIC code are: i, representing index number; j, representing index number; M, representing MIDI pitch number; O, representing Octave number; and N, representing Note number. Still referring to FIGS. 2 and 3, note designators are numbered from 0 to 12, where N(C)=0; N(C#)=1; N(D)=2; N(D#)=3; . . . ; N(B)=11; N(Top C)=12. Pitch number M is based on the indices i and j. Octave number, O, is the integer part of M/12. N is the remainder of M/12-O. C0 is the bottom note of the zeroth octave, where CO=440*2^(−69/12)=8.1758 cycles per second (Hz).

Figure 5:
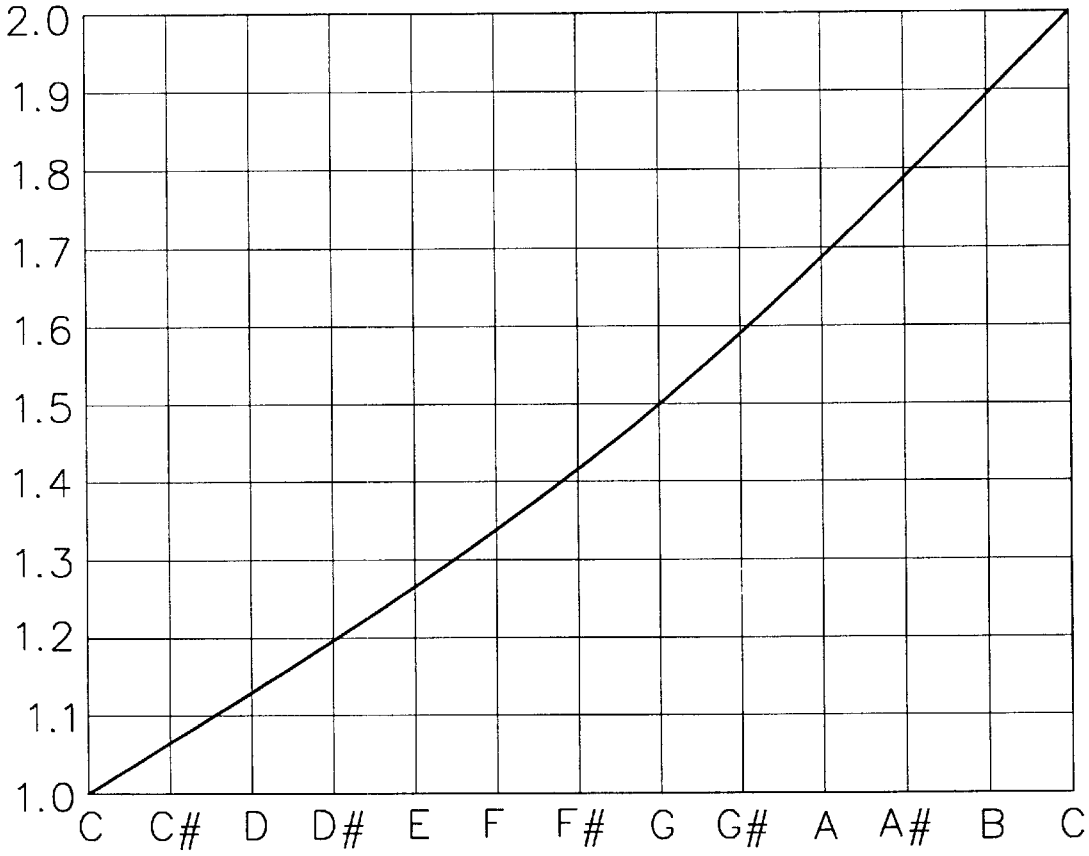
FIG. 5 is a graph of relative pitch showing the curve generated from the table in FIG. 4.

FIG. 4 is a table listing an octave normalized with respect to the top octave (84–96) of FIG. 2. As above, the sequence or half tone file is generated using a normalized pitch response. FIG. 5 is the curve generated from the far right column of the table of FIG. 4 and shows pitch along a single octave of notes. In FIG. 5, the y-axis represents the normalized pitch frequency from one to two; the x-axis represents notes of an octave from C to the next C.

A musical recording is a function of time. A digital musical recording in a sample domain can be transformed to a pitch domain by using the following relationship: P=I*R/N, where P is the recovered pitch; I is an integer representing the number of cycles per frame; R is the sampling rate (samples per second); and N is the number of samples per frame. The transformation uses linear increments of pitch by approximating the curve of FIG. 5 with one or more line segments.

Figure 6:
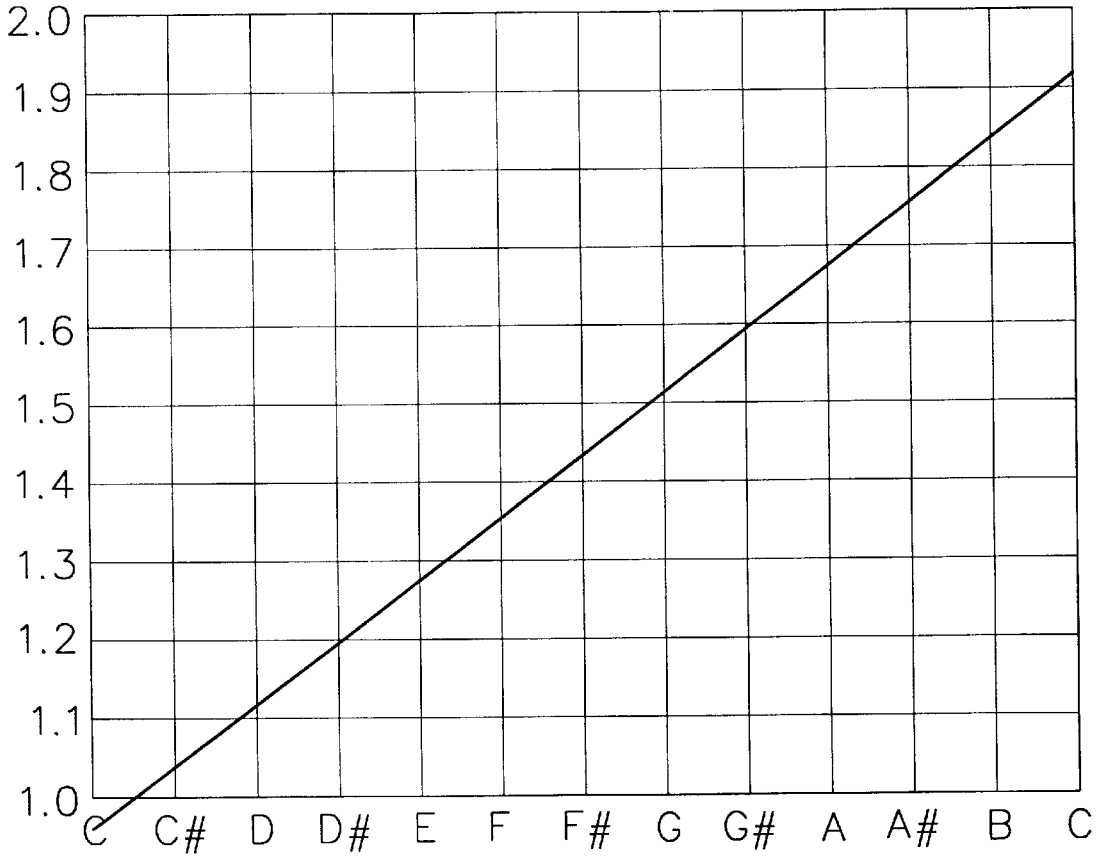
FIG. 6 is a straight line approximation of the curve of FIG. 5.

FIG. 6 is a single straight line approximation of the octave curve of FIG. 5, and FIG. 7 is a table which lists data comparing the straight line of FIG. 6 with the curve of FIG. 5. Column heading Coef represents the slope of the straight line and I represents linear increments of pitch. Column heading Fi is the pitch based on consecutive integers, and Fr is the normalized pitch from FIG. 4. The discrepancy percentage, cents (Cts), is estimated as Cents=1200*(Fi−Fr).

Figure 8:
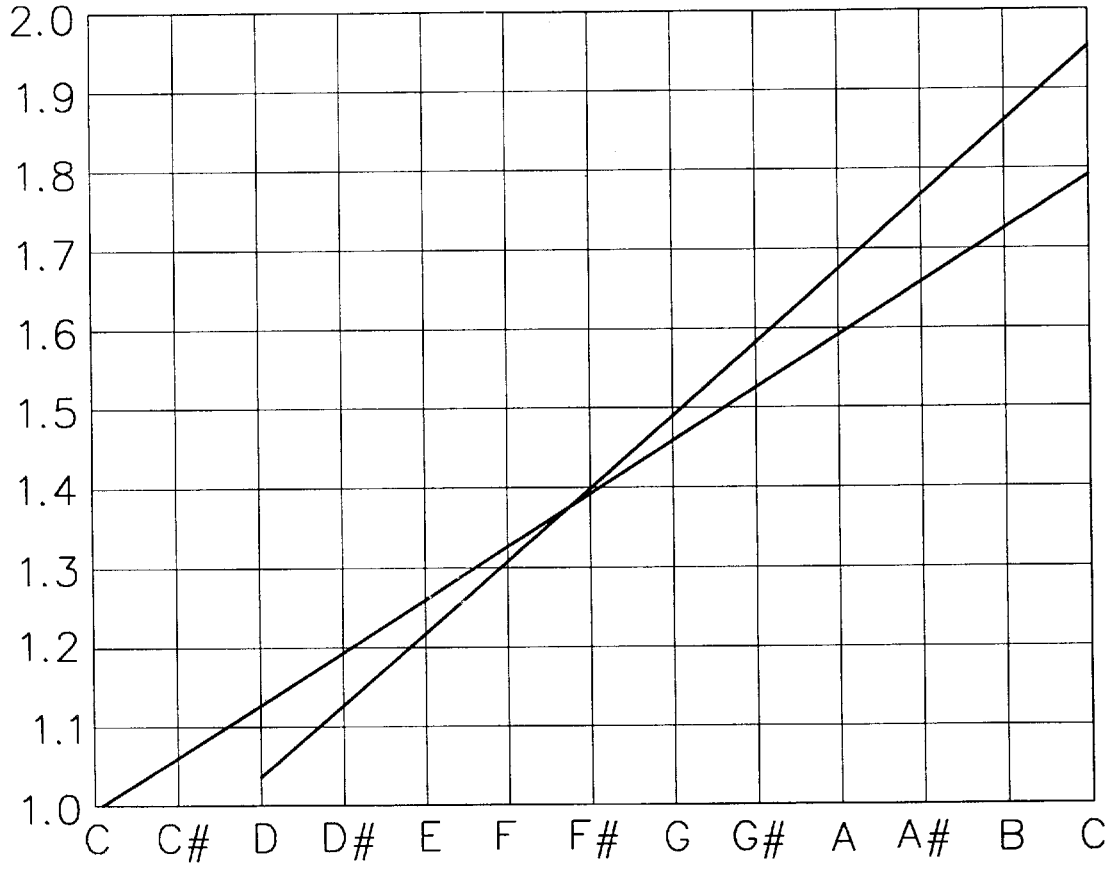
FIG. 8 is a graph showing a two-segment approximation of the curve shown in FIG. 5.

FIG. 8 is a two-segment approximation of the octave curve shown in FIG. 5. FIG. 9 is a table which lists data comparing the two-segment approximation of FIG. 8 with the curve of FIG. 5. Once again, the column heading Fi is the pitch based on consecutive integers and Fr is the normalized pitch of FIG. 5. The discrepancy percentage, cents (Cts), is estimated using the same formula as for the straight one-line approximation.

Figure 10:
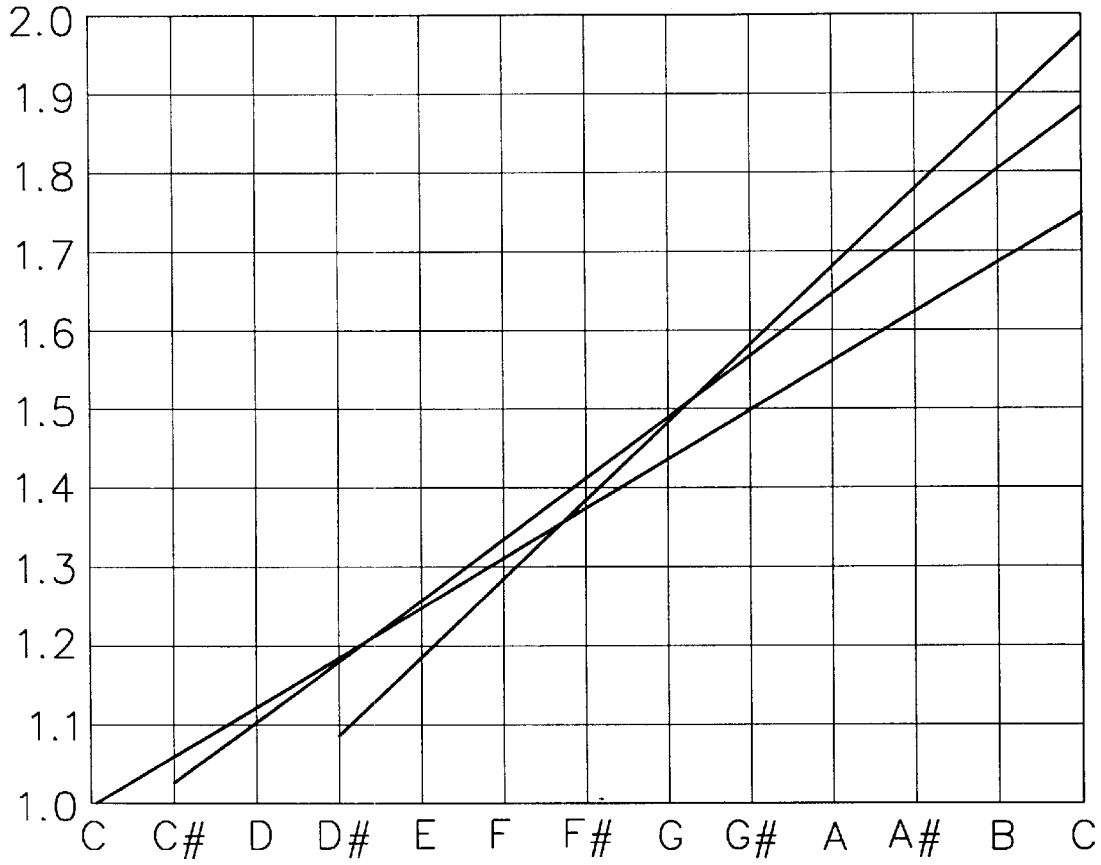
FIG. 10 is a graph showing a three-segment approximation of the curve in FIG. 5.

FIG. 10 is a three-segment approximation of the curve in FIG. 5. FIG. 11 is a table listing data comparing the three-segment approximation of FIG. 10 with the curve of FIG. 5. Again the discrepancy percentage between Fi and Fr is represented by cents (Cts) as calculated above. FIGS. 7, 9, and 11 each show discrepancies between equally tempered notes and notes which are approximated by integers.

Figure 12:
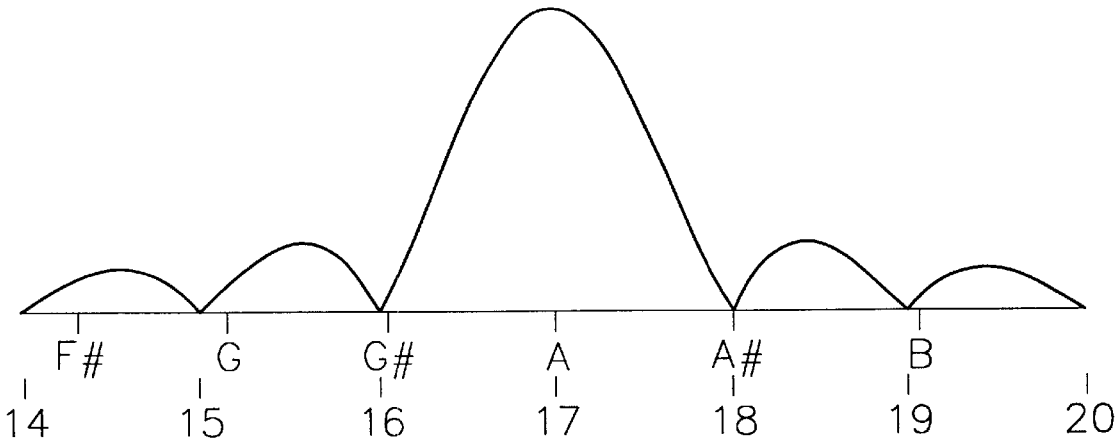
FIG. 12 is a graphical presentation of filter characteristics, or the relative transform response, of a single transformed pitch at 17 cycles per frame.

In the preferred embodiment, a Fourier response of a sinusoid is used to transform from time domain to pitch domain in generating the half-tone (sequence) file from the pseudo wave file (step 106 as in FIG. 1). This transformation uses linear increments of pitch to approximate the curve shown in FIG. 5 with one or more line segments as shown above. Accordingly, the transformation has the following relationship: P=I*R/N; where P is a pitch frequency in Hertz, R is the sample rate, N is the number of samples in a frame, I is one of a series of consecutive integers. FIG. 12 graphically shows filter characteristics, or the relative transform response of a single transformed pitch at an incident pitch frequency of 17 cycles per frame. Note that the notches are arithmetically spaced around and notes are geometrically spaced.

FIG. 13 is a table of transform response pitches based on incident pitches which vary from three half-tones below and above the 17 cycles per frame. The column headings of FIG. 13 are: Fi, incident pitch; Real, in-phase response pitch; Imag, Quadrature response; Abs, an Absolute response; and Si, defined as 64* (sin (pi*x)/x), where x=Fi—Fa. Columns Abs and Si show that the filter characteristics are proportional to the absolute value of (sin (pi*x)/x). It can be seen that the columns differ slightly from each other due to quantizing errors. FIG. 14 is an exemplary computer code used to generate the table in FIG. 13. FIG. 15 is a table listing the filter characteristics of the single transformed pitch at 17 cycles per frame such as shown graphically in FIG. 12. The amplitude of the curve shown in FIG. 12 and as tabulated in FIG. 15, is the normalized response to the incident pitch at the indicated pitch frequency according to the calculation scheme shown in FIG. 14.

The following is an exemplary calculation of sampling rates for the octave segments of interest when converting from the wave file to the pseudo wave files as in step 104 of FIG. 1. FIG. 16 lists calculations for determining sample rates for three cases: (a) 4 half-tones per segment; (b) 6 half-tones per segment; and (c) 8 half-tones per segment. In one exemplary embodiment, 11025 Hz is the sample rate of the digital musical recording. The sample rate is proportional to the pitch of its octave segment. The variables included in FIG. 16 are: Kr1—ratio of highest sample rate of the octave segment of interest to the recording sample rate; Kr2—lower sample rate ratio, which can be approximated as 2^(M/12), where M=Number of half-tones per segment; and, SR(X)—sample rate at the Xth segment.

In all three cases, when calculating Kr1 and KR2, both the denominator and numerator will desirably be below 100 samples per second, so that at the end of files used as inputs, there will not be any samples left over. Kr1 and Kr2 are derived from the approximation 2^(M/12), where M=Number of half-tones per segment. In case of (a) 4 half-tones per segment, Sr(0) is the sample rate of the recording, Sr(1) is the highest sample rate representing the highest pitch segment, Sr(2) is the sample rate of a segment that is ⅓ of an octave down from Sr(1) segments and Sr(4) is one full octave down from Sr(1) segment. The process repeats for the remaining Sr(X)'s. In case of (b) 6 half-tones per segment, Sr(0) is the sample rate of the recording, Sr(1) is the highest sample rate representing the highest pitch segment, Sr(2) is the sample rate of a segment that: is ½ of an octave down from the Sr(1) segment, and Sr(3) is one full octave down from Sr(1) segment. Again the process repeats for the remaining Sr(X)'s. Lastly, in the case of (c) 8 half-tones per segment, Sr(2) is the sample rate of a segment that is ⅔ of an octave down from Sr(1) segment.

Conventional musical standards include an ideal pitch to which a musical instrument may be tuned. A MIDI program or controller provides an algorithm which provides a generated pitch. The pitch generated by the MIDI algorithm detects the presence of activity (tone) at the particular half-tone. The difference between the ideal or musical standard pitch and the MIDI algorithm generated pitch can be expressed in cents. FIG. 17 is an algorithm or list of functions which are used to generate tables in FIGS. 18, 19, and 20, which include ideal pitch, generated pitch and the difference therebetween. FIG. 18 is a table listing characteristics of the 4 half-tones per segment case. FIG. 19 is a table listing characteristics of the 6 half-tones per segment case. FIG. 20 is a table listing characteristics of the 8 half-tones per segment case. The column headings for the tables shown in FIGS. 18–20 are: Sr, sample rate (samples per second); Cf, cycles per frame with 128 samples per frame; Pn, a pitch number; K, a music key such as C, C#, D, D#, E, F, etc.; O, octave; Pe, nominal pitch (equally tempered) in cycles per second; Pa, response center pitch; and, Cents representing the difference between the ideal pitch Pa, and the generated pitch Pe.

Figure 21A:
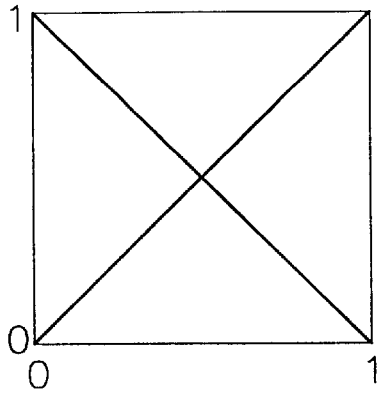
FIGS. 21A, 21B, and 21C are each graphic representations showing plots of interpolation polynomials.
Figure 21B:
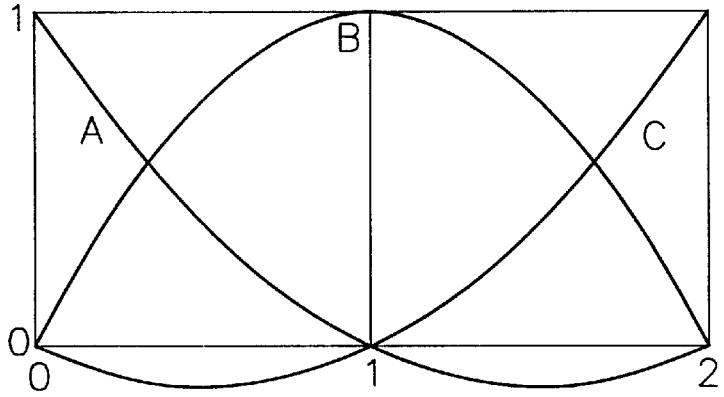
Figure 21C:
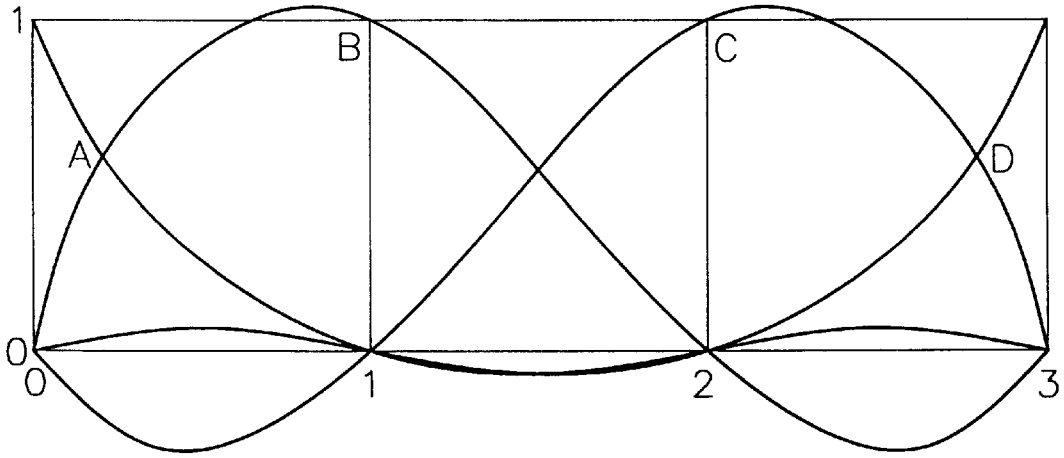

An interpolation process is preferably used to generate pseudo wave files from the wave files according to the following. Interpolation coefficients are utilized to approximate samples on the top octave's octave segments in order to produce a continuous pseudo wave file. FIGS. 21A, 21B and 21C are graphic representations of three sets of interpolation polynomials. The set of curves shown in FIG. 21A is for two-point interpolation. The set of curves shown in FIG. 21B is for three-point interpolation. The set of curves shown in FIG. 21C is for four-point interpolation. Interpolation coefficients are used to approximate each of the samples in an octave segment in order to generate a pseudo wave as in step 104 of FIG. 1. The polynomial curves in FIGS. 21A, 21B and 21C apply to interpolating among equally spaced two, three, and four ordinates, respectively. FIGS. 22A, 22B and 22C each include a list of equations used to generate the corresponding sets of curves in FIGS. 21A–21C. The polynomial equations in FIGS. 22A–22C are used to determine interpolation coefficients among two, three, and four points, respectively. The set of equations in FIG. 22A is used to produce the graph in FIG. 21A and is used to determine interpolation coefficients among two points. Similarly, the set of equations in FIG. 22B is used to produce the graph shown in FIG. 22C and is used to determine interpolation coefficients among three points. The same relationship is true for FIGS. 22C and 21C, for four point interpolation.

FIG. 23 is a table of interpolation coefficients which may be used to interpolate ordinate values using various interpolation functions. The table is used to obtain blocks of 29 equally spaced samples from blocks of 41 equally spaced samples. The source file is a stream of samples. The source stream is divided into blocks. Each block contains 44 samples. These samples are numbered in the j column of FIG. 23 from −1 to 39 where the remaining samples in the block are implicit as j+1, j+2 and j+3 when j=39. These latter 3 samples are renumbered as −1, 0, 1 when the next block of 41 new samples is taken from the input stream are numbered from 2 to 42. The X values represent the X-axis of the four point interpolation plot shown in FIG. 21C, in the 1.0 to 2.0 range. Each of the derived or interpolated samples which are numbered in column i from 0 to 28, are derived as follows: S(i)=K(A)*S(j)+K(B)*S(j+1)+K(C)*S(j+2)+K(D)*S(j+3). In order to save machine time and/or memory space, integer arithmetic may alternatively be implemented to produce normalized interpolation coefficients such as shown by the table of FIG. 24.

Figure 25:
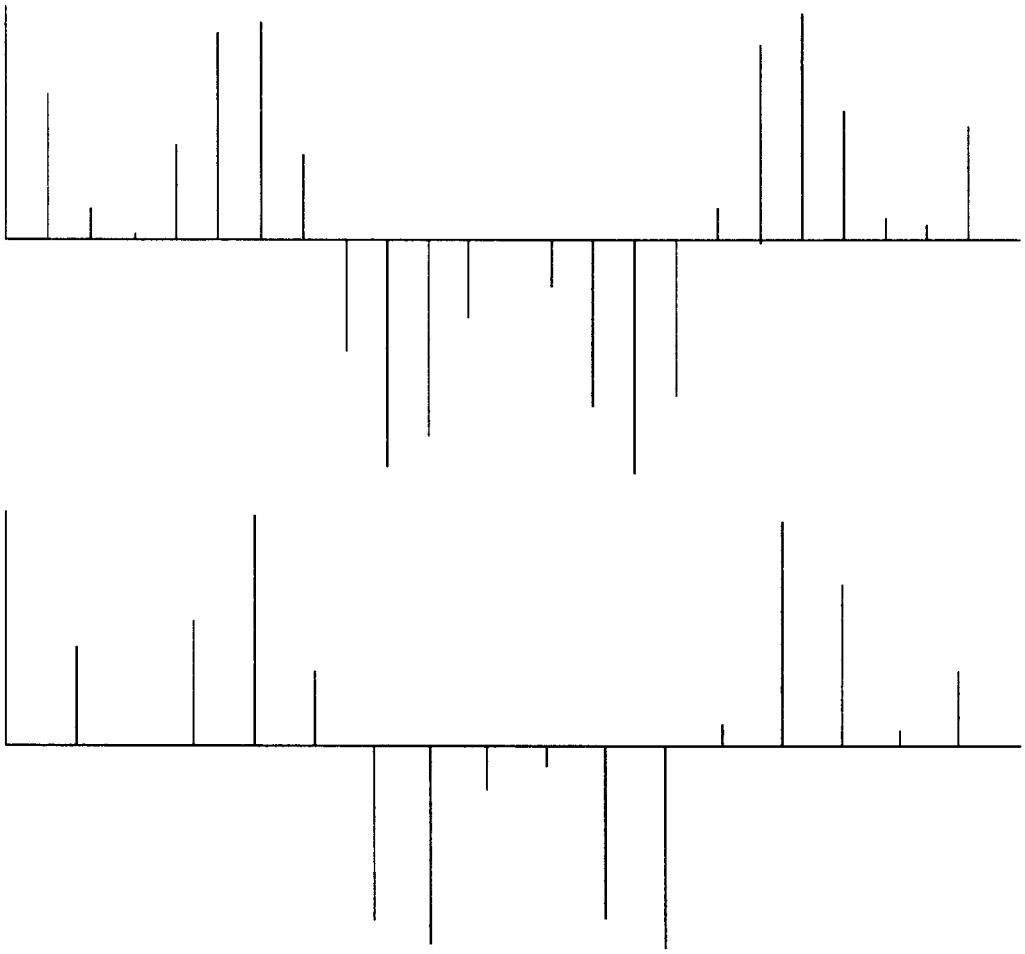
FIG. 25 is a graphical representation of 17 ordinate values obtained by interpolating among 24 samples.

FIG. 25 illustrates 17 ordinate samples (lower plot) derived from 24 samples (upper plot) using an interpolation procedure, such as which may use the interpolation coefficients provided in FIG. 23 or FIG. 24. Such a procedure is used to complete the generation of the pseudo wave file. It can be seen that smooth curves passing through ordinate ends in each case would be very nearly the same curve.

FIGS. 26, 27 and 28 represent an exemplary calculation embodiment in which response pitches are calculated for 61 notes listed in FIG. 2 and which are divided into 15 segments having 4 half-tones per segment in the three segment per octave case. The original sample rate of the recording is 11025 samples per second. 106 samples per frame is used in all cases. Sample rates are reduced according to K(i,j)=(½)

^i*(50/63)^j where i and j are integers. Integer i represents the number of octaves below the top octave and integer j represents number of segments below the top segment. The frame rate equal the sample rate divided by the number of samples per frame. Accordingly, frame rates in frames per second are calculated from K(i,j). FIG. 26 is a table which lists the frame rates in frames/second as integers i and j are varied. FIG. 27 is a table listing response pitches of the notes for various frame rates. Column headings are: Cf, cycles/frame; Fs, K(i,j) in frames/second; and Pitch frequency, (Cf*Fs). FIG. 28 is a table listing the discrepancies between the ideal pitch and the generated response pitch of FIG. 27, in cents.

FIGS. 29–31 combine to form a single flow chart which shows the step-by-step process of an exemplary embodiment of the method of the present invention. The various operations shown may be carried out using a conventional general purpose computer and appropriate software such as available in the art. The conventional computer may also include conventional peripheral devices such as a keyboard, monitor, printer, mouse, audio adapter and speakers. For example, the computer may provide the means for generating the pseudo wave file, generating the sequence file, generating the event list, and converting the event list into a MIDI or other notation program readable file. Any of several suitable programming languages may be used to program the computer to carry out the indicated operations as shown.

Referring now to FIG. 29, it can be seen that the first step is memory allocation. The digital musical recording is stored as a wave file in this memory section. Memory space is also reserved for 5 constants, three tables and a short section of a sample stream. Generated tables include interpolation tables and a trigonometric table according to an exemplary embodiment.

According to an exemplary embodiment, the first table may be used to generate pseudo wave file 7.5. Pseudo wave files are numbered from 2.0 to 7.5 in increments of 0.5. File number 2.0 is used in the generation of the lower six half-tone files of octave 2. The generation of half-tone or sequence files will be shown in FIG. 30. Pseudo wave file 2.5 is used in the generation of the six half-tone files for the upper half of octave 2. Pseudo wave file 7.5 is used to generate the half-tone files of the upper half of octave 7. Pseudo wave file 7.5 is used in the generation of other files:

a. it is used in the generation of pseudo wave file 7.0;
b. it is used in the generation of pseudo wave file 6.5;
c. it is used in the generation of 7 half-tone files of the upper segment of octave 7; and
d. it is used in tempo resolution.

Ad All other pseudo wave files are generated by dividing the repetition rate by two. Six half-tone files are generated from each of the remaining 11 pseudo wave files. FIG. 32 shows a list of 12 exemplary pseudo wave files so created.

FIG. 30 is a flow chart showing an exemplary series of operations for generating a sequence file from the pseudo wave file. The flow chart shown in FIG. 30 follows sequentially from the flow chart shown in FIG. 29. The sequence files so generated may more appropriately be referred to as half-tone sequence files or simply half-tone files.

FIG. 33 is a list of the same 12 pseudo wave files shown in FIG. 32, together with the half-tone (sequence) files that these pseudo wave files are used to generate. Half-tone files are numbered from 24 to 96 using MIDI pitch numbers.

FIG. 31 is a flow chart following sequentially from the flow chart shown in FIG. 30. FIG. 31 is an exemplary embodiment of the method of the present invention showing an event list generated from the sequence file. Again, the reader is reminded that a sequence file is more appropriately referred to as a half-tone file. FIG. 31 shows the event list derived from each of the half-tone (sequence) files. These events include start time and stop time of a half-tone with time skew removed. The events include strike and release velocities. The events are tagged with their pitch numbers and sorted by time of occurrence. According to an alternative embodiment not shown in FIG. 31, the event list may be modified by a user after it is generated.

From the generated or modified event list, a notation program readable file such as the MIDI file shown in the exemplary embodiment shown in FIG. 31, is generated. It should be understood that other notation program readable files may be generated alternatively. After the MIDI or other notation program readable file is generated, it is then imported into a notation program. The musical score may then be printed from the notation program (not shown in FIG. 31).

The preceding description merely illustrates the principles of the invention. It will be thus appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposed to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention as well as specific examples thereof, are intended to encompass functional equivalents thereof. Additionally, it is intended that such equivalents include both currently known equivalents as well as equivalents developed in the future, i.e. any elements developed that perform the same function regardless of structure.

As such, the invention is not intended to be limited to the detail and examples shown. Rather, various modifications and additions may be made in the details within the scope and range of equivalents of the claims and without departing from the invention. For example, the present invention may include programming in any suitable computer language without departing from the scope of the invention.

The scope of the present invention is best understood by the appended claims.

What is claimed is:

1. A method for obtaining a musical score from a musical recording, comprising the steps of:

storing a digital musical recording as a wave file;

generating a pseudo wave file for each octave segment of interest of the wave file;

generating a sequence file for each of the pseudo wave files;

generating an event list from the sequence files; and converting the event list into a notation program readable file.

2. The method of claim 1, further comprising the step of importing the notation program readable file into a notation program.

3. The method of claim 2, further comprising the step of printing the musical score.

4. The method of claim 1, further comprising the step of editing the event list prior to the step of converting the event list into a notation program readable file.

5. The method of claim 1, wherein the step of generating a sequence file comprises generating the sequence file using a, Fourier response of a sinusoid.

6. The method of claim 1, wherein the notation program readable file comprises a MIDI file.

7. The method of claim 1, wherein the sequence file comprises a half-tone file.

8. The method of claim 1, wherein the musical recording includes a sample rate of one of 11025 samples/second, 22050 samples/second and 44100 samples/second.

9. The method of claim 1, wherein each octave segment includes one of four and six half-tones.

10. The method of claim 1, wherein there are 15 octave segments of interest including 5 selected octaves, each selected octave having three octave segments.

11. The method of claim 1, wherein a length of the pseudo wave is measured in frames and each frame includes 128 samples per frame.

12. The method of claim 1, wherein the step of generating a pseudo wave includes interpolating to approximate samples in the wave file.

13. The method of claim 12, wherein the interpolating is carried out between one of two, three and four points.

14. A system for obtaining a musical score from a musical recording, comprising:

means for storing a digital musical recording as a wave file;

means for generating a pseudo wave file for each portion of the wave file;

means for generating a sequence file for each of the pseudo wave files;

means for generating an event list from the sequence files; and means for converting the event list into a notation program readable file, said means for generating a pseudo wave file including means for interpolating to approximate samples in the wave file.

15. The system of claim 14, further comprising means for importing the notation program readable file into a notation program.

16. The system of claim 15, further comprising means to print the musical score from the notation program.

17. The system of claim 14, further comprising means for editing the event list.

18. The system of claim 14, wherein the notation program readable file is a MIDI file.

19. The system of claim 14, further comprising a computer which includes each of the means for generating a pseudo wave file, the means for generating a sequence file, the means for generating an event list, and the means for converting the event list.

* * * * *